US011554947B2

(12) United States Patent
De Groot et al.

(10) Patent No.: US 11,554,947 B2
(45) Date of Patent: Jan. 17, 2023

(54) PRESSURE REGULATING SYSTEM FOR A BEVERAGE CONTAINER AND BEVERAGE CONTAINER PROVIDED THEREWITH

(71) Applicant: Heineken Supply Chain B.V., Amsterdam (NL)

(72) Inventors: Allard De Groot, Amsterdam (NL); Germán Enrique Knoppers, Amsterdam (NL); Vincent Schats, Amsterdam (NL); Thomas Theodorus Nicolaas Johannes Wagemakers, Amsterdam (NL)

(73) Assignee: HEINEKEN SUPPLY CHAIN B.V., Amsterdam (NL)

( * ) Notice: Subject to any disclaimer, the term of this patent is extended or adjusted under 35 U.S.C. 154(b) by 0 days.

(21) Appl. No.: 17/042,391

(22) PCT Filed: Apr. 11, 2019

(86) PCT No.: PCT/NL2019/050215
§ 371 (c)(1),
(2) Date: Sep. 28, 2020

(87) PCT Pub. No.: WO2019/199168
PCT Pub. Date: Oct. 17, 2019

(65) Prior Publication Data

US 2021/0024344 A1 Jan. 28, 2021

(30) Foreign Application Priority Data

Apr. 12, 2018 (NL) ..... 2020756

(51) Int. Cl.
*B67D 1/12* (2006.01)
*B67D 1/04* (2006.01)

(52) U.S. Cl.
CPC ..... *B67D 1/1252* (2013.01); *B67D 1/0418* (2013.01)

(58) Field of Classification Search
CPC ..... B67D 1/1252; B67D 1/0418
See application file for complete search history.

(56) References Cited

U.S. PATENT DOCUMENTS 3,258,163 A * 6/1966 Brush ..... B65D 83/663 222/61
3,881,636 A 5/1975 D'Aubreby
(Continued)

FOREIGN PATENT DOCUMENTS

BE 1003980 A3 * 7/1992 ..... B65D 83/663
BE 1003980 A3 7/1992
(Continued)

OTHER PUBLICATIONS

Machine Translation of BE 1003980 A3, Espacenet, www.epo.org.*
(Continued)

*Primary Examiner* — Jeremy Carroll
(74) *Attorney, Agent, or Firm* — Pearne & Gordon LLP

(57) ABSTRACT

A pressure regulating system for a beverage container system, comprising a first, compartment for containing a pressurized gas, in fluid communication with an outlet space through at least a gas valve for opening and closing a passage between the first compartment and the outlet space, wherein a gas valve control system is provided, comprising a deformable and/or movable wall or wall part of said outlet space, wherein said deformable and/or movable wall part is operably in contact with said gas valve for opening and/or closing said gas valve, wherein a second compartment is provided at a side of the said deformable and/or movable wall part opposite the outlet space, wherein the second compartment is in fluid communication with a third com-
(Continued)

partment, which third compartment comprises at least one separating wall part and is at least liquid tight.

23 Claims, 13 Drawing Sheets

(56) References Cited

U.S. PATENT DOCUMENTS

| | | | | |
|---|---|---|---|---|
| 4,456,155 | A * | 6/1984 | Miyata | B67D 1/0412 239/308 |
| 5,180,081 | A | 1/1993 | McCann | |
| 5,285,931 | A * | 2/1994 | Alfons | B65D 83/663 222/61 |
| 5,439,137 | A * | 8/1995 | Grollier | B65D 83/663 222/394 |
| 6,230,767 | B1 | 5/2001 | Nelson | |
| 2010/0059543 | A1* | 3/2010 | Paauwe | B67D 1/0418 222/399 |

FOREIGN PATENT DOCUMENTS

| | | | |
|---|---|---|---|
| CN | 1334775 | A | 2/2002 |
| CN | 1906097 | A | 1/2007 |
| CN | 102971230 | A | 3/2013 |
| CN | 106458557 | A | 2/2017 |
| EP | 1064221 | B1 | 1/2001 |
| WO | 99/44890 | A1 | 9/1999 |
| WO | 200035774 | A1 | 6/2000 |
| WO | 2012085607 | A1 | 6/2012 |
| WO | 2015190926 | A1 | 12/2015 |

OTHER PUBLICATIONS

International Preliminary Report on Patentability for PCT/NL2019/050215 dated Aug. 10, 2020, 17 pages.
International Search Report and Written Opinion for PCT/NL2019/050215 dated Jul. 12, 2019, 10 pages.
Search Report issued in Corresponding Russian Patent Application No. 2020136941 dated Jun. 1, 2022.

* cited by examiner

PRESSURE REGULATING SYSTEM FOR A BEVERAGE CONTAINER AND BEVERAGE CONTAINER PROVIDED THEREWITH

The disclosure relates to a beverage dispensing system with a pressurizing system which is self regulating. The disclosure relates to a method for manufacturing of a pressure regulator and a method for preparing a pressure regulator for use. The disclosure furthermore relates to a beverage container comprising a pressure regulator of the disclosure, wherein the container is or can be filled with a gaseous beverage, such as a carbonated beverage.

In EP1064221 a beverage dispensing system is disclosed, comprising a container with a self regulating pressurizing system. The pressurizing system comprises a gas container comprising pressurized gas, a closure closing the gas container and a pressure regulator operative for opening the closure for allowing gas to enter into the beverage compartment from the gas container. The pressure regulator comprises a regulating chamber having at least a wall part movable based on pressure in the beverage compartment, such that when the pressure drops in the beverage compartment, for example due to dispensing beverage therefrom, the movable wall will move and will open the closure of the gas container, allowing gas to enter into the beverage compartment, increasing the pressure therein. This will move the movable wall back, allowing the closure to close again once the desired pressure in the beverage compartment is reached. Similar regulators are disclosed in for example EP1064221 and WO200035774.

These regulators have the problem that $CO_2$ gas may enter into the regulating chamber due to migration of the gas through the wall into the chamber for equalizing the partial pressure of CO2 gas on either side of said wall, which gas will not leave the chamber anymore during use of the regulator. This will increase the internal pressure in said chamber over time, which will increase the regulating pressure inside the beverage compartment accordingly. Furthermore these pressurizing systems have the disadvantage that the regulating pressure is set at a given, predetermined value, such that at a predetermined, preferred temperature of the beverage the pressure will be regulated at about the equilibrium pressure of the beverage, such that the carbonation of the beverage at that temperature will not change. This means that at other temperatures the pressure will be regulated above or below said equilibrium pressure and thus will lead to over or under saturation of gas in the beverage. Moreover, when the beverage is cooled to a low temperature, this may reduce the pressure inside the container to such a level that the pressure regulator will start regulating undesirably.

In WO2015/190926 a beverage dispensing system is disclosed in which a pressure regulator is used which should overcome at least some of these problems of previously known pressure regulators. In this known system the pressure regulator comprises a first compartment for containing a pressurized gas. This first compartment is in fluid communication with an outlet space through at least a gas valve for opening and closing a passage between the first compartment and the outlet space. A gas valve control system is provided, comprising a deformable or movable wall part of said outlet space. The deformable or movable wall part is operably in contact with said gas valve for opening and closing the gas valve. A second compartment is provided at a side of the said deformable or movable wall part opposite the outlet space. In this known system the second compartment is in fluid communication with the beverage compartment of the beverage container though a small opening is set of openings, such that gas from the second compartment can flow into the beverage compartment and vice versa. The opening or openings together are so small that such flow from the second compartment into the beverage compartment and vice versa can only happen relatively slowly. Hence in theory the pressure inside the second compartment can adjust relatively slowly to the pressure inside the beverage compartment.

It has been found that in practice a pressure regulator as disclosed in WO2015/190926 does not always perform properly. Undesired pressure fluctuations during use still occur. Therefore there is a desire to further improve a pressure regulator for a beverage container.

An aim of the present disclosure is to provide for a pressure regulator which is an alternative to the known pressure regulator.

One of the objects of the disclosure is to provide for a pressure regulator which can automatically regulate pressure in a beverage container, especially a beverage container comprising a gaseous and/or pressurized beverage, such as beer. An object is to provide a pressure regulator which can adjust a regulating pressure to for example changes in beverage temperature and/or gas content.

An object of the present disclosure is to provide for a beverage container, preferably self pressurizing. An object of the present disclosure is to provide for a method for preparing a pressure regulator for use in a beverage container comprising a pressurized, gas containing beverage, such as beer. An object of the present disclosure is to provide for a method for manufacturing a pressure regulator or at least part thereof.

At least one of these aims and objectives and/or other objects are obtained at least in part by a pressure regulator as disclosed. A pressure regulator according to the disclosure comprises a first compartment for containing a pressurized gas. The first compartment is or can be brought in fluid communication with an outlet space through at least a gas valve for opening and closing a passage between the first compartment and the outlet space. A gas valve control system is provided, comprising a deformable and/or movable wall or wall part of said outlet space, wherein said deformable and/or movable wall part is operably in contact with said gas valve for opening anchor closing said gas valve. A second compartment is provided at a side of the said deformable and/or movable wall part opposite the outlet space. A pressure regulator according to the disclosure can further be characterized in that the second compartment is in fluid communication with a third compartment, which third compartment comprises at least one separating wall part and is liquid tight.

Surprisingly it has been found that by adding a third compartment to a regulator, as claimed, having a separating wall or wall part, the pressure regulation by the pressure regulator can be significantly improved.

In embodiments the separating wall part can be part of or can be or comprise a movable and/or deformable wall part. In embodiments the separating wall part can be gas permeable and substantially fluid tight.

In embodiments the second compartment can be in fluid connection with the third compartment through at least one opening or through a series of openings, wherein the opening has or the openings have a combined cross sectional area of less than about between 5 and 1000 $(\mu m)^2$, for example between 5 and 100 $(\mu m)^2$, such as for example between 10 and 50 $(\mu m)^2$.

More general the fluid connection between the second and the third compartment can be such that there is a flow restriction between the two compartments, such that a relatively rapid reduction or expansion of the volume of the second compartment, by deformation and/or movement of the movable and/or deformable wall of the second compartment provides for a pressure increase respectively decrease in the second compartment, which is subsequently relieved through flow of gas from the second compartment into the third compartment of vice versa. The separating wall part of the third compartment will in embodiments allow for a change in volume of the third compartment without significant change in pressure inside the third compartment.

In embodiments the separating wall part of the third compartment can comprise at least a movable and/or deformable wall part allowing increase and decrease of an internal volume of the third compartment, wherein the movable and/or deformable wall part of the second compartment allows for an increase and decrease of the volume of the second compartment. The fluid connection between the second and third compartment in embodiments can be designed such that a change in volume of the second compartment will lead to a volume change of the third compartment with a time lag and vice versa.

During use during use at least the first, second and third compartment can be substantially filled with the same gas or gas mixture, in gaseous and/or liquid form, especially $CO_2$. Obviously other gases can be used, for example NO2, or gas mixtures. In embodiments the gas or gas mixture can be the same as a gas or gas mixture in a beverage to be dispensed.

Preferably during use in a rest position a pressure difference over the separating wall part will be no more than about 15000 Pascal (150 mbar), preferably less than 10000 Pascal (100 mbar), more preferably less than 7500 Pascal (75 mbar), such as for example about 5000 Pascal (50 mbar) or less.

In embodiments the separating wall part can comprise a foil, especially a plastic foil, preferably a substantially non-elastic foil. The foil is preferably such that it does substantially not influence pressure inside the chamber closed at least in part by said foil. In embodiments the foil can be connected to a wall of the third compartment, spaced apart from a separating wall separating the third compartment from the second compartment. The foil can be shaped and/or dimensioned such that it can rest against substantially the full inner surface of the walls of the third compartment, preferably without being stretched. In such position the internal volume of the third compartment can be substantially zero, but can increase by pushing the foil away from the walls.

In embodiments a stop can be provided for the separating wall part, limiting a possible volume increase of the third compartment by movement and/or deformation of the separating wall part. In embodiments the volume of the third compartment can be larger than the volume of the second compartment, at least when comparing the maximum volumes of the second and third compartments.

In embodiments the third compartment can comprise at least one flushing opening, which during use of the regulator for pressure regulation is closed. Such flushing opening allows flushing of the third compartment with a gas or gas mixture, especially a gas or gas mixture used for pressurizing the beverage, which opening of openings are closed after such flushing.

The disclosure is further directed to a beverage container, comprising a pressure regulator of the disclosure. The outlet space can open, directly or indirectly, into a beverage compartment of the beverage container. The separating wall part can be provided, directly or indirectly, in fluid contact with said beverage compartment.

The disclosure is further directed to a method for preparing a pressure regulator according to the disclosure, wherein at least the third compartment is purged with a gas or gas mixture present in a beverage to be pressurized with said pressure regulator. Such gas can for example be $CO_2$ gas or a $CO_2$ gas mixture. In embodiments the third compartment is flushed with said gas or gas mixture, by feeding the gas or gas mixture into the third compartment through a first opening and allowing air to be forced out of said third compartment by said gas or gas mixture through a second opening, and subsequently closing the openings. Such purging can be done directly prior to or directly after placing the pressure regulator in the beverage container and closing the container when filled with the beverage. Such beverage can be a carbonated beverage such as beer.

The disclosure is further directed to a method for manufacturing a pressure regulator according to the disclosure, wherein a regulator part is formed comprising at least the second compartment and a bottom wall and a peripheral wall of the third compartment. A foil is connected to the peripheral wall spaced apart from the bottom wall, closing off the third compartment. The third compartment is evacuated, such that the foil is plastically deformed, drawing the foil against an inside of the peripheral wall and the bottom wall. During deformation the foil may be heated in order to allow plastic deformation. The foil can for example be a plastic foil such as a vacuum drafteable foil, such as for example but not limited to PE foil.

In clarification of the invention, exemplary embodiments of pressure regulators, beverage containers and methods according to the disclosure will be further elucidated with reference to the drawings. In the drawings.

Figure 4B:
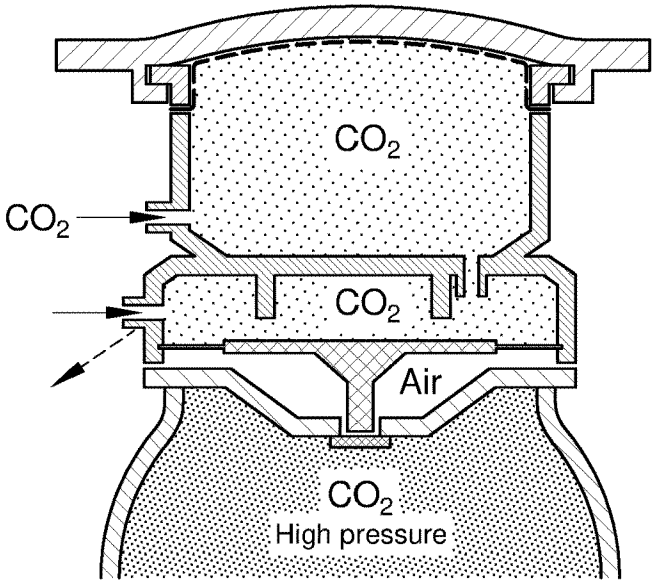
Figure 4C:
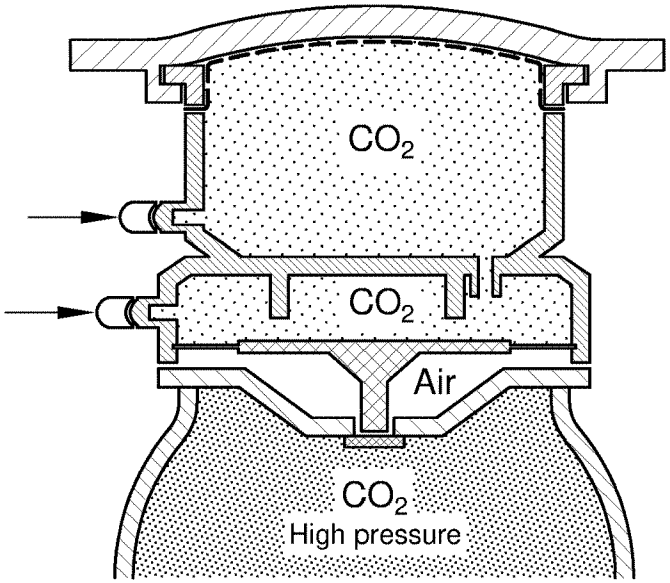
Figure 4A:
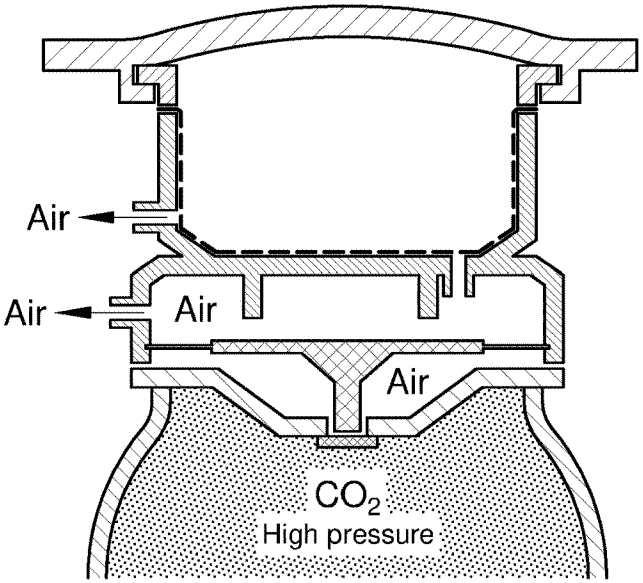
Figure 5A:
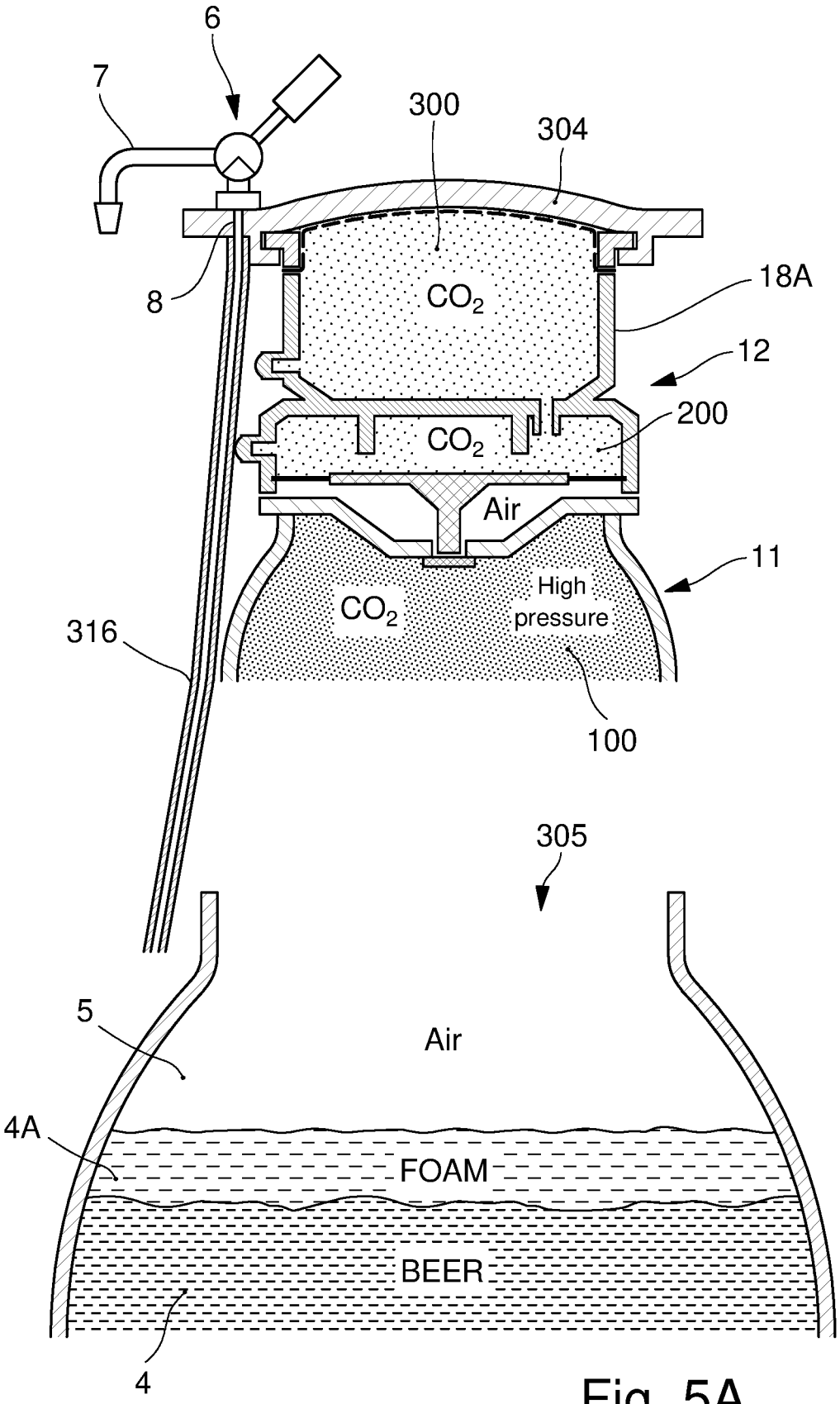
Figure 6:
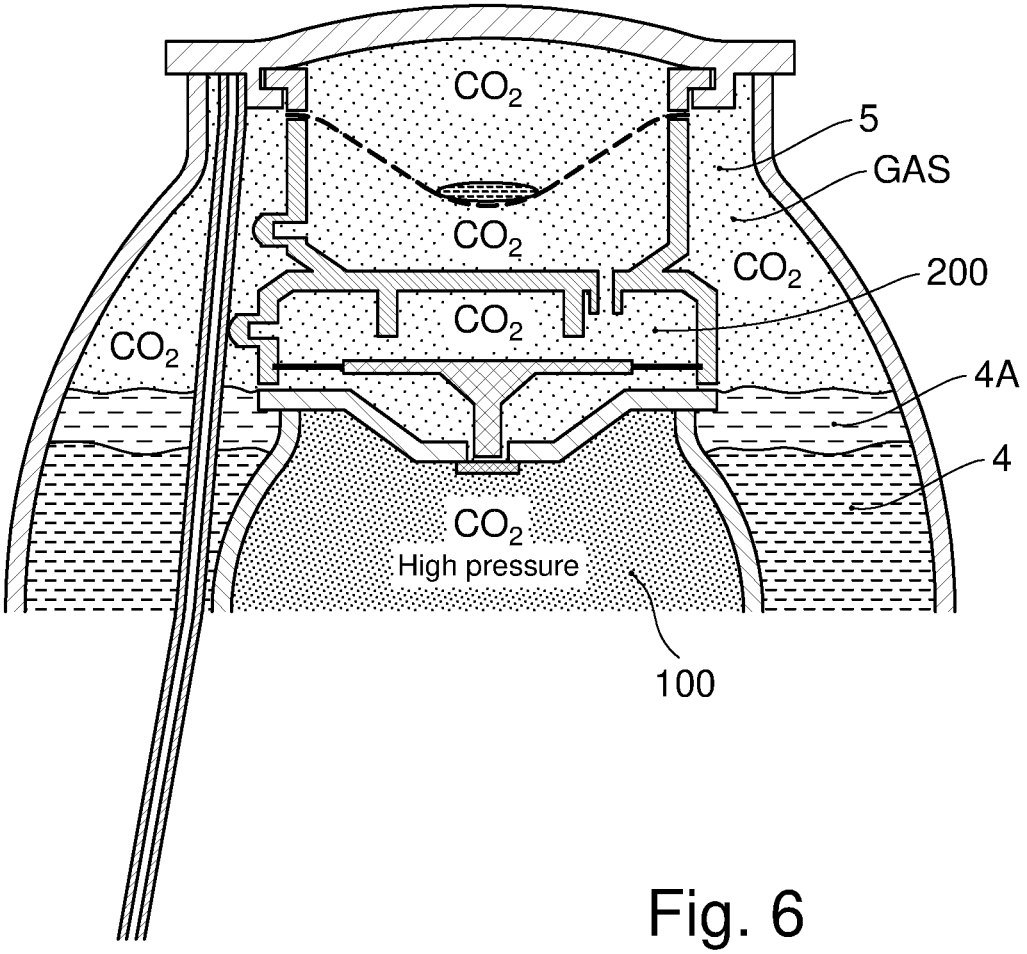
Figure 7A:
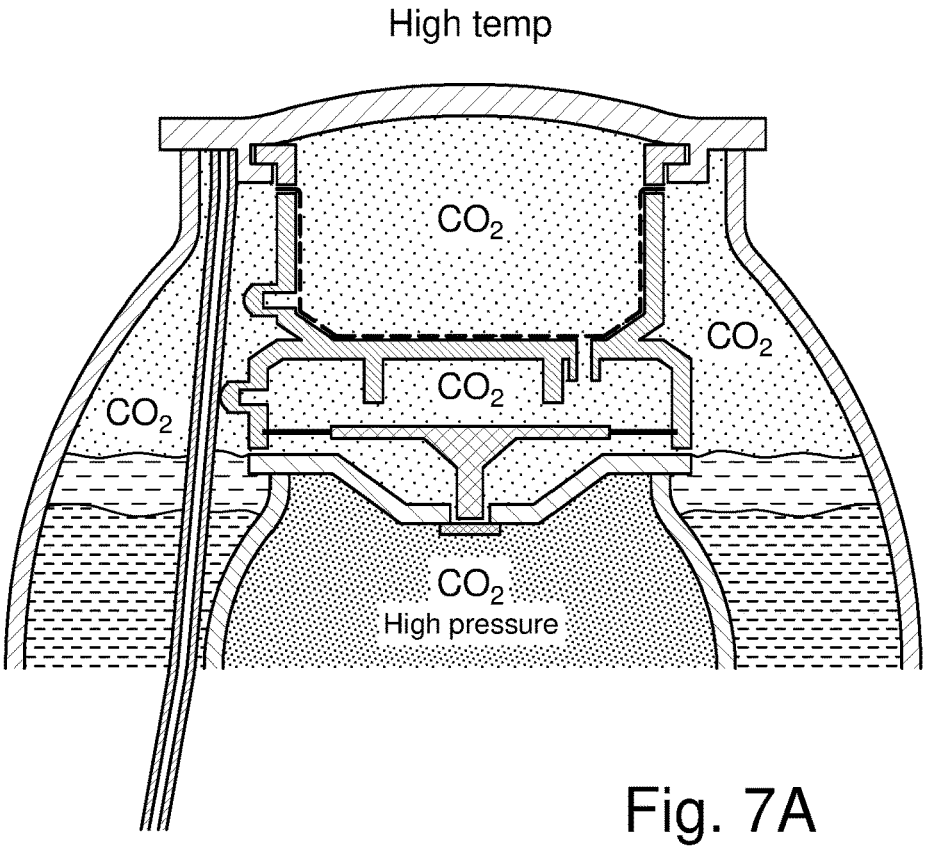
Figure 8A:
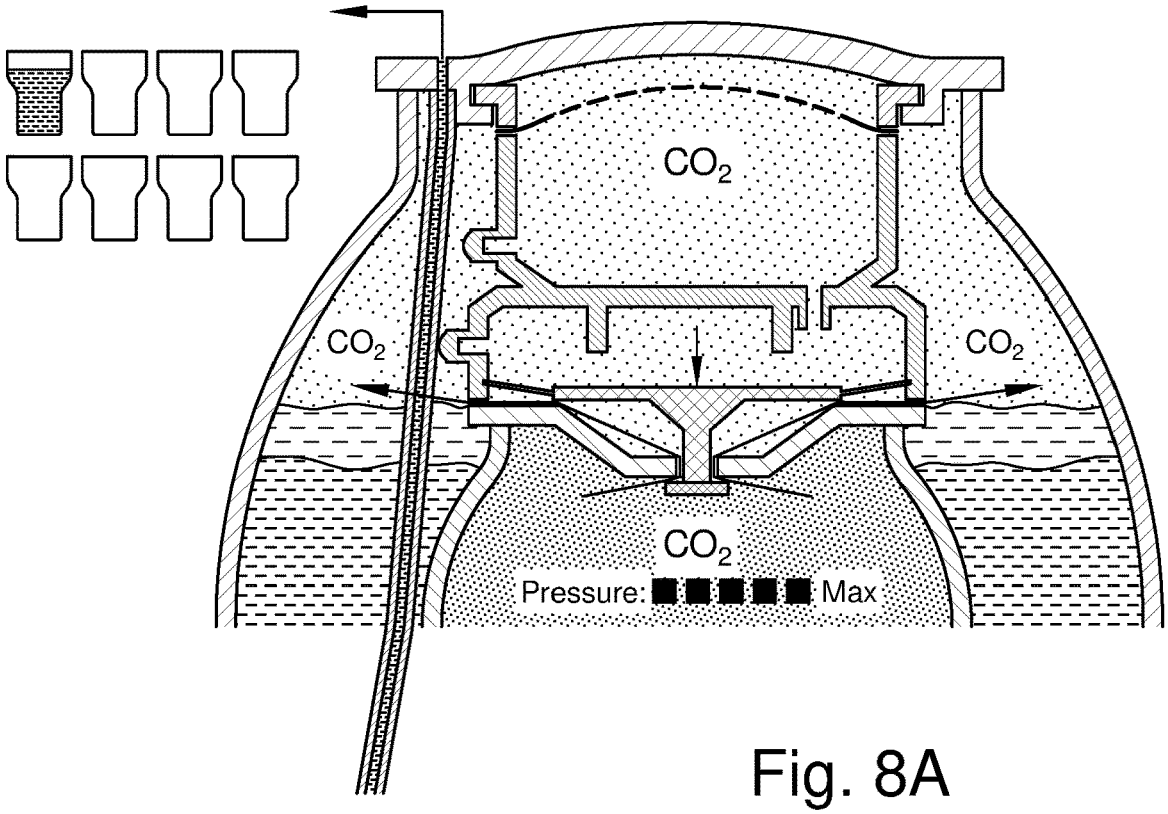
Figure 8B:
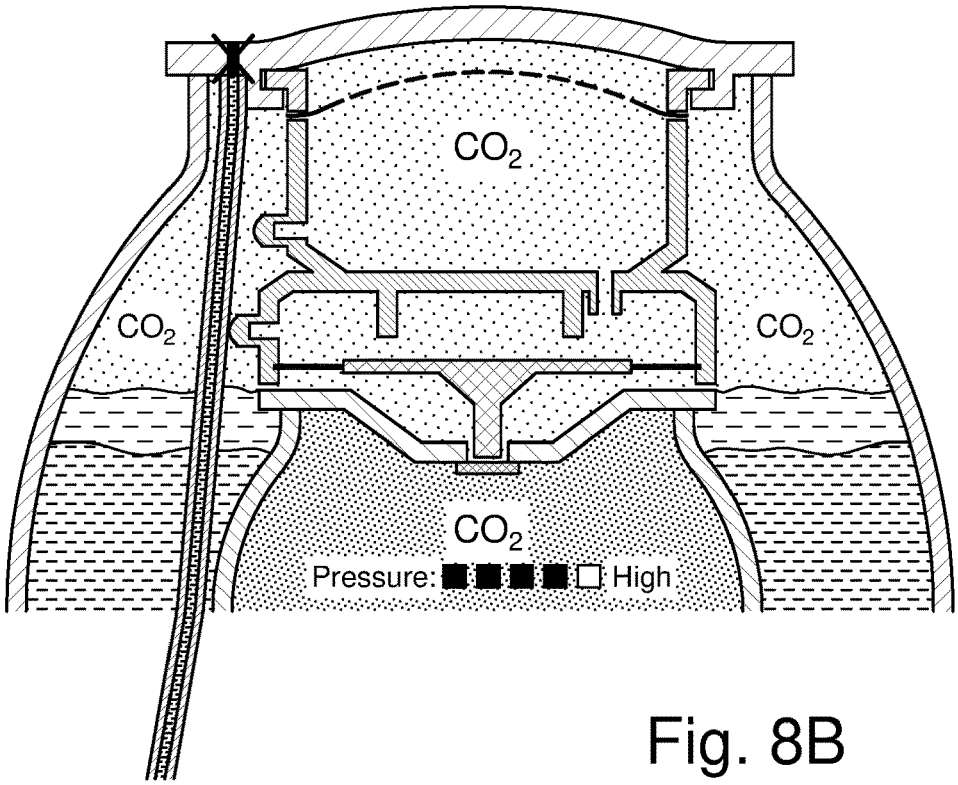
Figure 9:
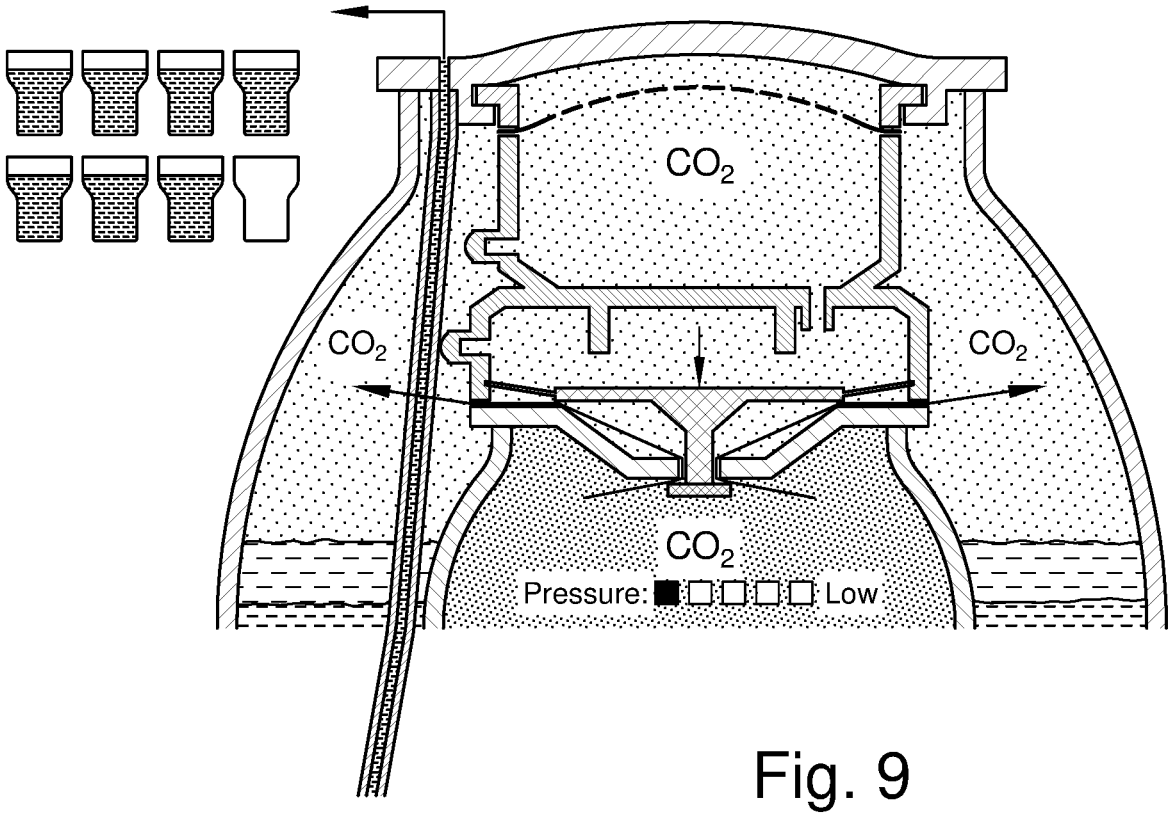
Figure 11:
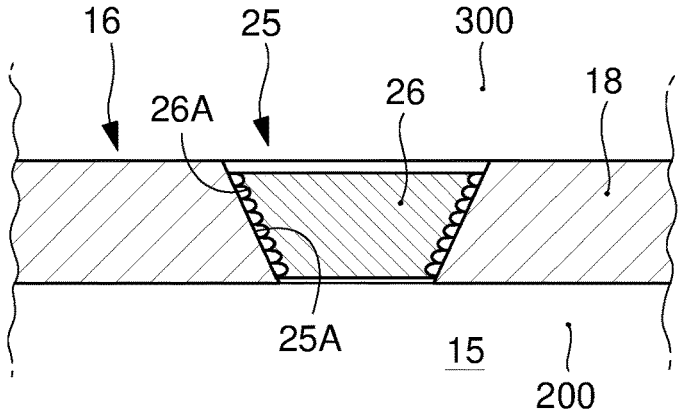
Figure 12:
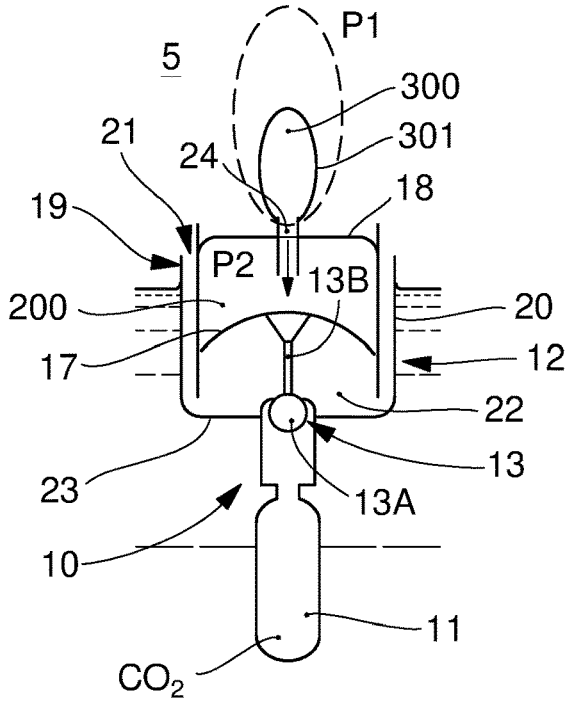
Figure 13:
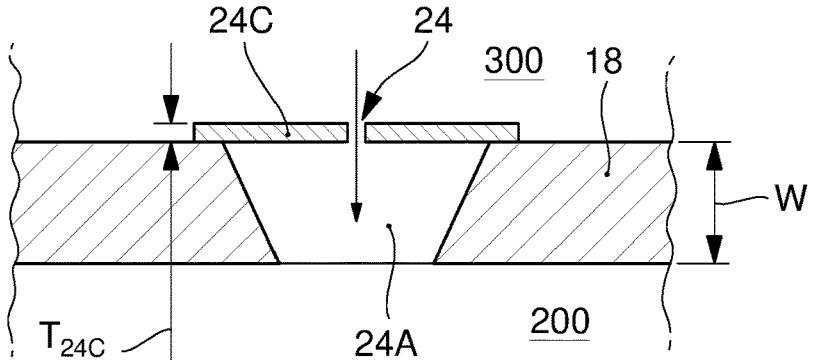

FIG. 3A-F show, schematically, in cross sectional view, steps in a method of manufacturing a pressure regulator;

FIG. 4A-C show, schematically, in cross sectional view, steps in a method for preparing a pressure regulator for use;

FIGS. 5A and B show, schematically, in cross sectional view, steps in mounting a pressure regulator in a container and closing the container;

FIG. 6 shows, schematically, in cross sectional view, a container comprising a pressure regulator, for example during transport or storage;

FIGS. 7A and B show, schematically, in cross sectional view, a container comprising a pressure regulator of the disclosure, at relatively high and relatively low temperature of the container;

FIG. 8A shows schematically a system of the disclosure during dispensing of a serving of beverage, in particular a first or at least one of the first servings;

FIG. 8B shows schematically the system of FIG. 8A, directly after closing of the draw of tap;

FIG. 9 schematically shows the system of FIGS. 8A and B, during dispensing of a serving when the container is already substantially emptied of said beverage;

FIG. 10A-E show, schematically, in cross sectional view, different embodiments for a separating wall or wall part for a pressure regulator;

FIG. 11 shows schematically an alternative passage for gas between the second and third compartment;

FIG. 12 shows schematically part of an alternative embodiment of a pressurizing device; and FIG. 13 shows schematically part of a wall with an alternative embodiment of an opening.

In this description embodiments of beverage dispensing systems, pressure regulators, containers and pressurizing systems, as well as methods are disclosed by way of examples only. In the different embodiments the same or similar parts and features have the same or similar reference signs.

In this description embodiments of beverage dispensing systems and especially containers forming such system or forming part thereof will be disclosed, comprising a pressurizing system with which the pressure in a beverage compartment of the container can be regulated such pressurizing system may also be referred to as pressure regulator or pressure regulating system. Regulation of pressure should be understood as at least encompassing maintenance of the pressure in the beverage compartment within a predetermined pressure range, at least during periods in which no dispensing takes place. Such regulation can be obtained by a pressure regulator which operates a closure of a high pressure gas container, further also referred to simply as gas container or a first compartment, provided in or for the pressurizing system, such that when the pressure inside the beverage compartment drops the pressure regulator can open a closure of the gas container, allow gas to flow into the beverage compartment, increasing the pressure therein. This will again operate the pressure regulator such that it will allow the closure of the gas container to close again. Such systems are well known in the art and for example disclosed in EP1064221 and WO200035774 and used in the Draught-Keg®, marketed by Heineken, The Netherlands.

In this disclosure substantially should be understood as at least meaning for the largest part or almost entirely. Small deviations of for example a given size or value or such characteristic are acceptable within the definition of substantially, such as for example deviations of less than 20%, more specifically less than 15%, more specifically less than 10%, such as for example less than 5% of a given numeric or proportional value.

In the present disclosure a pressurizing system is disclosed which has a pressure regulating chamber or second compartment, which is in communication with a third compartment, such that over a period of time an equilibrium can be obtained between the pressure inside the pressure regulating chamber or second compartment and the pressure inside the beverage compartment, by flow of gas, especially $CO_2$ gas, from the third compartment into the pressure regulating chamber or vice versa. The third compartment is fluid tight, such that no beverage will enter into the third compartment.

In this disclosure a separating wall or separating wall part should be understood at least as meaning a wall or wall part separating a third chamber from en environment of the pressure regulator, especially from a beverage compartment when placed in or in contact with a beverage compartment of a beverage container. Separating should be understood at least as meaning preventing beverage or foam from entering into the third chamber. The separating wall is preferably at least movable, deformable and/or gas permeable, such that the volume of the third chamber is adjustable and/or pressure can be regulated in said third chamber by at least said separating wall or wall part.

This can mean that when the pressurizing device is under atmospheric pressure, e.g. outside the beverage container or prior to filling of the beverage container, the pressure inside the pressure regulating chamber of the pressure regulator will be atmospheric too, and thus the closure of a gas container connected to the pressure regulator will be closed and the pressurized gas inside the gas container will stay in said gas container. The pressure in the third compartment will also be atmospheric. After filling of the beverage container with a carbonated beverage such as beer and closing the beverage compartment, the pressure inside the beverage compartment will be above atmospheric and thus the pressure regulator will be inactive in the sense that the closure of the gas container will be closed. $CO_2$ gas contained in the carbonated beverage will act on a pressure regulating wall or wall part of the third compartment, to such extend that it will provide that the pressure inside the pressure regulating chamber will become about the same as the pressure in the beverage compartment. Thus the pressure regulator becomes activated, meaning that a relatively quick pressure drop in the beverage compartment, especially due to dispensing of a quantity of beverage therefrom, will lead to the pressure regulator opening the closure of the first compartment or gas container, for compensation of the pressure drop due to the dispensing, by feeding gas from the gas container into the beverage compartment until the desired gas pressure inside the beverage compartment has been reached again. Since the gas can only slowly flow into and/or out of the pressure regulating chamber into the third compartment, during the pressure drop in the beverage compartment due to the dispensing of beverage the pressure inside the regulating chamber will be maintained at substantially the same level, thus keeping the pressure regulator active and operative to open the closure of the gas container.

In a pressure regulator system of the disclosure the third chamber preferably has a separating wall or wall part, allowing for an increase or decrease of the volume of the third compartment. Preferably the volume of the third compartment can change such that an amount of gas or gas mixture can be introduced into or removed from said third compartment without a significant change in the pressure in the third compartment or at least resulting in a pressure change significantly smaller than a pressure change which would occur when the same amount of gas or gas mixture would be brought into a compartment have a fixed volume of about the same size as the third compartment having a volume central between a maximum and minimum volume, which can also be referred to as an average volume (minimal volume+(maximum volume−minimum volume)/2). In embodiments the pressure regulating wall or wall part can be designed such that when used in a beverage container containing a pressurized beverage the pressure regulating system will drive to an equilibrium pressure situation wherein there is no significant difference in pressure between the pressure in the third compartment and the pressure in the beverage compartment of the container containing the beverage. No significant pressure difference should preferably be understood as a pressure difference of no more than 15%, preferably no more than 10%, more preferably no more than 5% pressure difference between the said pressures, especially when measured when the pressure in the second and the pressure in the third compartment is the same. By way of example, which should not be considered limiting the scope of the disclosure, if the beverage is a beverage, for example beer, at an absolute pressure of 1.6 bar, the pressure difference between the third compartment and the pressure in the beverage compartment (1.6 bar absolute) may be less then 0.24 bar, preferably less than 0.16 bar, more preferably less than 0.08 bar.

The possibility that over a period of time an equilibrium can be obtained between the pressure inside the second compartment, forming a pressure regulating chamber, and the pressure inside the third compartment, and hence in the beverage compartment, by flow of gas, especially $CO_2$ gas, from the third compartment into the second compartment or vice versa, can also have the advantageous effect that a temperature change in the system, especially of the beverage, can be followed by the pressure regulator. For example after filling of the beverage container the temperature of the beverage may rise, for example during transport and storage, in a store or at a consumers place. This will lead to an increase of pressure in the beverage compartment. Since in a system according to the present disclosure gas can flow between the third compartment and the second compartment during cooling of the beverage, the pressure inside the pressure regulating chamber will easily follow the pressure reduction in the beverage compartment, by gas flowing out of the regulating chamber into the third compartment, without significantly increasing pressure in the third compartment. Similarly, when the temperature of the beverage would rise again, the pressure inside the pressure regulator chamber will also follow a pressure rise inside the beverage compartment due to a temperature change easily and automatically.

In a pressure regulator possible gas flow debit is limited between the second and third compartment, such that it will take a significantly longer time for reaching an pressure equilibrium than the time necessary for dispensing of a serving of beverage. Hence a dispensing a serving of beverage will allow the movable an/of deformable wall or wall part of the second compartment to allow a volume increase of the second compartment, opening the valve of the first compartment for raising the pressure again inside the beverage compartment. A relatively quick pressure increase inside the beverage compartment will on the other hand first increase the pressure inside the second compartment, reducing the volume thereof. Then gas will flow slowly out of the second compartment into the third compartment, without increasing pressure inside the third compartment significantly, such that overtime again a pressure equilibrium will be obtained.

In a system according to the present disclosure the pressure inside the pressure regulating chamber, referred to also as the regulating pressure, will fluctuate with temperature changes in the container to such extend that the regulating pressure will at different temperatures be in line with the equilibrium pressure of the beverage, which is the pressure at a given temperature at which the gas content of the beverage will be maintained at a desired, predetermined level. Thus at such equilibrium pressure at the given temperature the saturation of gas in the beverage will be maintained at said predetermined, desired level, for example the level of the beverage as original produced. For different temperatures the equilibrium pressure will be different and the regulating pressure will automatically be adapted to that changed pressure.

In the present disclosure an opening between the second compartment and the third compartment should be understood as meaning any gas connection which allows gas to flow either way between said chamber and said compartment, for substantially obtaining an equilibrium in pressure between the regulating chamber and the beverage compartment over a period of time. Such opening or openings can for example be but is not limited to one or more bores, channels, pinholes, perforations, gas permeable membranes or the like, or for example a passage obtained by surface roughness of mating surfaces or the like.

In the present disclosure a period of time referred to with respect to the period in which gas can flow into or out of the pressure regulating chamber should be understood as a period relatively long compared to the period in which a serving of beverage is dispensed from the beverage compartment. Such serving can for example contain about 0.2 to 0.5 liter or for example about a pint, which will be dispensed within a few seconds. The period of time as indicated over which pressure equilibrium can be reached will in such circumstances be a multiplicity of such dispensing time, for example minutes to tens of minutes, i.e. long enough to maintain the regulating pressure ill the pressure regulating chamber during the dispensing of said serving or even several such servings. The regulating pressure in this respect should be understood as meaning the pressure prevailing inside the pressure regulating chamber directly prior to said dispensing of such serving.

A pressure regulating system according to the disclosure will react to a sudden drop in pressure, since than the valve of the gas container will be opened for supplying gas into the beverage compartment, but almost not to sudden pressure increases, since this will only push the movable or deformable wall further into the pressure regulating chamber, compressing the gas therein.

Figure 1B:
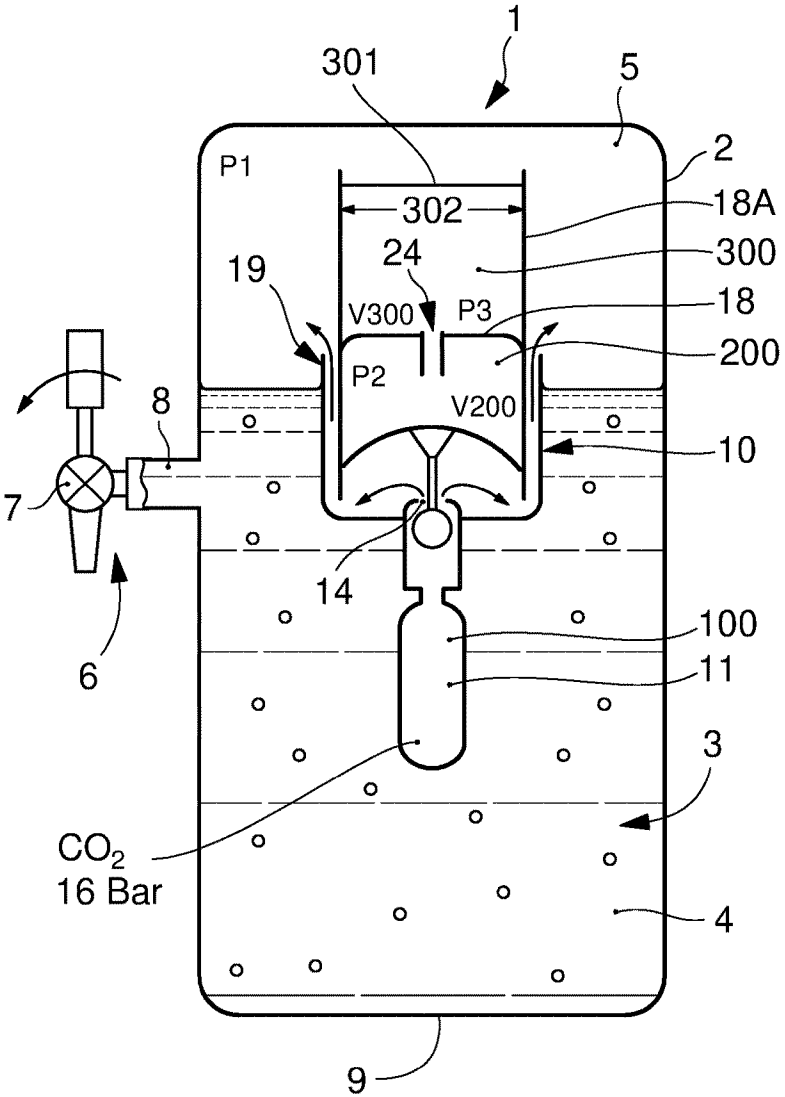
FIGS. 1A and 1B show, schematically, a container or beverage dispensing system according to the disclosure, with a first embodiment of a pressurizing device in a rest position and during dispensing respectively.
Figure 1A:
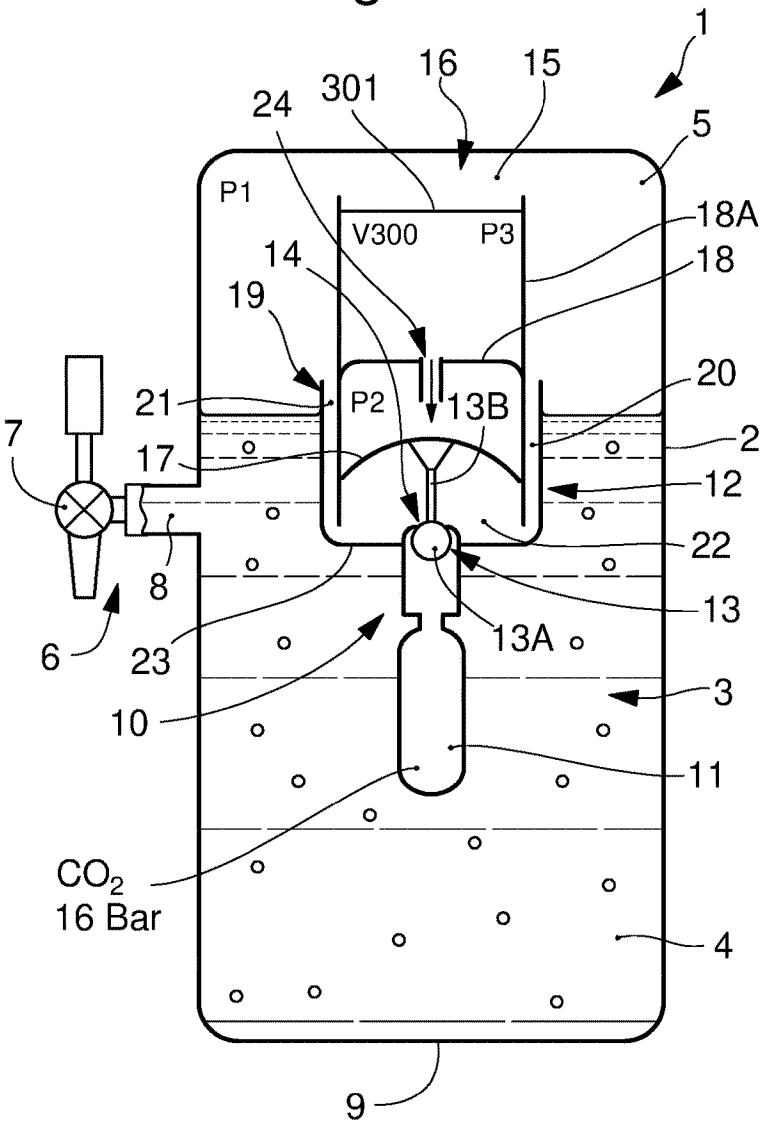
Figure 2:
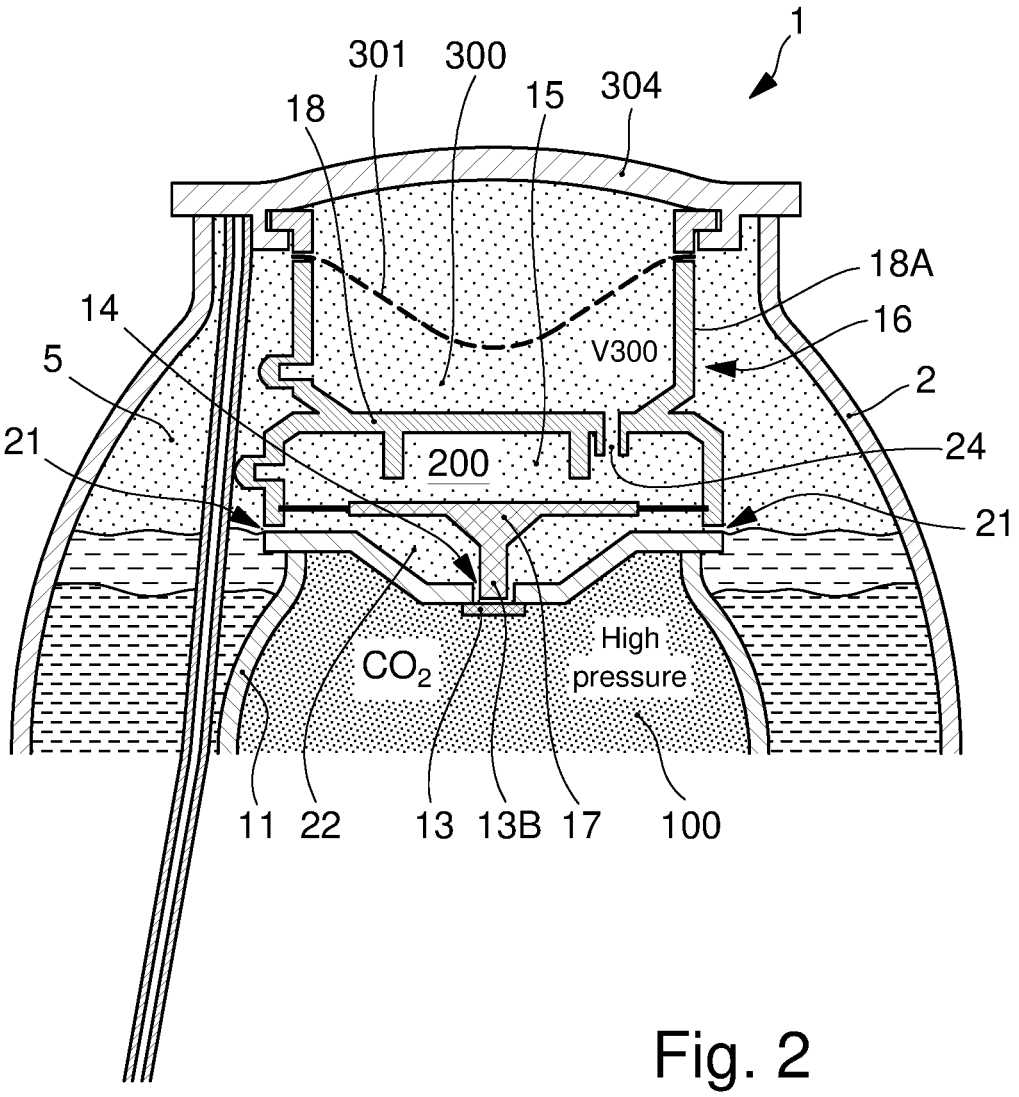
FIG. 2 shows, schematically, part of a container or beverage dispensing system according to the disclosure, in a second embodiment.

FIGS. 1 and 2 show an embodiment of a container 2 forming a beverage dispensing system 1, especially for carbonated beverages such as beer. However, also non-carbonated beverages could be dispensed with such system. The container 2 comprises a beverage compartment 3 at least partly filled with a carbonated beverage such as beer 4. A head space 5 is provided above the beverage 4, filled with gas, in the embodiment shown $CO_2$ gas. For different beverages this could however be a different gas, such as for example but not limited to nitrogen gas, air, oxygen or the like, or a gas mixture of such gasses. Schematically a dispensing provision 6 is shown, comprising a tap 7 connected to an outlet 8. A clip tube (e.g. shown in FIG. 5-9) can be connected to the outlet 8, extending to close to the bottom 9 of the container 2, in a known manner. Any suitable dispensing provision known can be used with a system 1 of this disclosure with which beverage can be dispensed from the beverage compartment 3.

Inside the container 2, especially in the beverage compartment 3, a pressurizing system 10 is provided, comprising a gas container 11 and a pressure regulator 12. A valve system 13, further also referred to as closure, is provided for closing an outlet 14 of the gas container 11. The gas container 11 is or comprises a first compartment 100 filled with pressurized gas such as $CO_2$ gas, for example initially at a pressure of several bar absolute (1 bar=100 kPa). For example but not limited to above 10 bar, for example about 16 bar or even higher. The amount of gas contained in the gas container 11 is preferably sufficient for dispensing the entire content of beverage from the container 2. A gas adsorbing and/or absorbing material, such as but not limited to active coal may be provided inside the gas container 11, as is known in the art.

The pressure regulator 12 is operative for opening the closure 13 and comprises a pressure regulating chamber 15 in a housing 16. The pressure regulating chamber forms a second compartment 200. The housing 16 at the side of the gas container 11 is provided with a wall part 17 forming part of the wall 18 of the pressure regulating chamber 15. In this embodiment the wall part 17 is a deformable wall part 17, such as a membrane. Alternatively or additionally the wall part 17 can be a movable wall part such as a piston, sealing against an inside of the wall 18 for forming a pressure regulating chamber 15 of which the internal volume can change, as will be discussed. Connected to the gas container 11 is an outer housing part 19, open towards the head space 5, in the embodiment shown at a side opposite the gas container 11. The outer housing part 19 has a peripheral wall 20 surrounding the wall 18 of the pressure regulating chamber 15. Between the peripheral wall 20 and the wall 18 at least one channel 21 is provided, forming an outlet opening, connecting the head space 5 with a outlet space 22 enclosed between the wall part 17 and a bottom 23 of the outer housing part 19. The at least one channel 21 is such that the gas pressure $P_1$ prevailing inside the head space 5 will be substantially the same as the pressure in said gas space 22, acting on one side of the wall part 17.

In the pressure regulating chamber 15 a second pressure $P_2$ will be present, acting on the opposite side of the wall part 17, that is the side facing inward to the pressure regulating chamber 15. A third compartment 300 is provided in the pressure regulator 12, here shown as part of the housing 16 above the pressure regulating chamber 15.

The third compartment 300 is preferably fluid tight, as is the second compartment or pressure regulating chamber 15, meaning that the beverage cannot pass into said compartments, nor foam thereof. The third compartment 300 can have the wall 18 as a bottom wall and a peripheral wall 18A extending therefrom. In the embodiments shown the third compartment is closed by a separating wall or wall part 301. In embodiments the separating wall or wall part 301 can be designed to allow changes of the internal volume $V_{300}$ of the third compartment. In embodiments the separating wall or wall part 301 can allow gas to pass in to and out from the third compartment from or to the beverage compartment substantially freely. In such embodiments the said wall or wall part 301 can for example be formed of or comprise a gas permeable but beverage tight membrane, such as but not limited to a semi permeable membrane, for example Gore-tex®.

In the embodiment shown in FIG. 1-7 the separating wall 301 is formed substantially by a foil, especially a relatively thin, flexible foil. The foil can for example be a thin plastic foil, such as but not limited to a PE based foil. Foil should in this disclosure be understood as at least meaning a film or sheet of material, flexible and having a small thickness compared to a length and width direction perpendicular to each other and to the thickness.

In embodiments the foil forming the separating wall 301 can have a surface area larger than the opening 312 defined by the peripheral wall 18A, such that the internal volume $V_{300}$ of the third compartment 300 can increase or decrease without stretching the foil.

In the wall 18 of the pressure regulating chamber 15 an opening 24 is provided, connecting the internal volume V of the pressure regulating chamber 15 with the third compartment 300. For the sake of clarity in the drawings this opening 24 is shown far larger than its actual size. Gas can flow from the pressure regulating chamber 15 into the third compartment 300 and vice versa through said opening 24. The opening 24 has a cross section which is for example considerably smaller than the cross section of the at least one channel 21 and is preferably at least such that a sudden movement of the wall part 17 into said housing 16, reducing the volume V of the chamber 15, or in opposite direction, increasing the volume V of the chamber 15, will lead to a pressure change inside the pressure regulating chamber or second compartment 200, due to the fact that gas cannot flow into or out of the pressure regulating chamber 15 through said opening 24 quickly enough to prevent such pressure change, whereas over a longer period of time a pressure equilibrium can be obtained. The separating wall or wall part 301 on the other hand will allow for a change in volume $V_{300}$ of the third compartment substantially without a change in the pressure prevailing therein.

As discussed, in the embodiments of the disclosure preferably during use in a rest position, during which the temperature of the beverage stays substantially the same and no beverage is dispensed, a pressure difference over the separating wall is maintained preferably below 15000 Pascal, preferably less than 10000 Pascal (100 mbar), more preferably less than 7500 Pascal (75 mbar), such as for example about 5000 Pascal (50 mbar) or less.

In the embodiment of FIGS. 1 and 2 the closure 13 is provided comprising an element 13A connected to the wall 17 by a stein 13B, forming a valve. The element can for example be a disc, a cone or a ball or any other body suitable for opening and closing the outlet 14. If the pressure difference over the wall 17 is such that the stein 13B is moved up in FIG. 1 or 2, the element 13A will be forced into the outlet 14, closing the outlet 14. Preferably said element 13A is not physically connected to the stein 13B, such that the stein 13B can for example travel further upward in FIGS. 1A and B than the element 13A, the stein 13B temporarily losing contact with said element 13A. If however the pressure difference over the wall 17 is such that the stein 13B is moved down in FIG. 1 or 2, the element 13A will be forced out of the outlet 14, opening the outlet 14. The wall 17 may be formed or tensioned such that it biases the element 13A into the outlet 14 when there is no pressure difference over the wall 17, especially at atmospheric pressure, for maintaining the outlet closed prior to activation. Obviously other valves can be used in stead, such as an aerosol valve or valves as disclosed in the prior art referred to in the introduction to this specification. The element 13A can be biased into the closed position.

In FIG. 1A the container is shown in rest, i.e. the dispensing provision 6 is closed and no beverage is being dispensed. In the beverage compartment 3 and especially in the head space 5 the first pressure $P_1$ prevails, whereas in the chamber 15 the second pressure $P_2$ prevails. In the third compartment a pressure $P_3$ will prevail. If $P_1$ and $P_2$ are not the same, for example because the container 2 has just been filled and closed, or the beverage is being or has been cooled or heated, compensation will occur over a period of time, such that after such time the pressures $P_1$ and $P_2$ will become the same. For example, if $P_1$ is higher than $P_2$, gas will flow from the third compartment 300 into the chamber 15, whereas if $P_2$ is higher than $P_1$ gas will flow in the opposite direction, from the chamber 15 into the third compartment 300. Thus an equilibrium will be obtained between these pressures. In an equilibrium situation the pressure $P_3$ will be substantially the same as the pressures $P_1$ and $P_2$.

Since after filling and closure of the container 2 a relatively long period will be available before the container is used for dispensing, due to at least transport to for example a store, bar or consumer, the period for obtaining such equilibrium may be relatively long, for example hours or even days. Similarly, since cooling or heating of the beverage will not be sudden but will take tens of minutes to several hours, depending on for example the volume and relevant temperature differences, again the period of time over which the gas may flow into and/or out of the pressure regulating chamber 15 from or into the third compartment 300 can be relatively long, for example minutes to hours.

In FIG. 1B the container 2 is shown during dispensing of a serving of beverage 4. In this stage the tap 7 is opened long enough to dispense a serving of beverage 4 from the container 2 into for example a glass (not shown). During the period of dispensing the pressure $P_1$ will drop relatively quickly. Since the pressure $P_2$ in the chamber during this relatively short period of dispensing will stay substantially the same, the pressure difference over the wall 17 will force the stein 13B in the direction of the gas container 11, thus opening the valve and allowing gas under pressure to leave the gas container 11 through the opening 14 and into the outlet space 22, from which it will flow into the head space 5 and beverage compartment 3, increasing the pressure therein back to the desired starting pressure $P_1$. When the pressure $P_1$ is back at the desired pressure the wall 17 will allow the valve to close again.

As discussed, since the flow of gas through the at least one opening 24 into or from the chamber 15 from or into the third compartment is relatively slow compared to the flow of the beverage during dispensing and the supply of gas from the first compartment 100, the regulating pressure $P_2$ in the chamber 15 will change little to nothing during such dispensing period. The movement and/or deformation of the wall part 17 will moreover be so small that the increase or decrease of volume therein will also hardy influence the pressure $P_2$. Thus the desired regulating pressure and a given temperature will mainly be maintained.

In a pressure regulating device 10 of the present disclosure the regulating pressure is not a fixed pressure but a pressure which will be set dependent on the equilibrium pressure of the beverage to be dispensed, basically irrespective of the temperature of the beverage. The amount of gas leaving the beverage inside the container during a given period of time will be equal to the amount of gas (re)entering said beverage, maintaining the level of saturation of the beverage. Due to the at least one opening 24 and the separating wall or wall part 301 a change in the equilibrium pressure due to a temperature change in the beverage will also be followed by the regulating pressure in the pressure regulating chamber 15 and thus the pressure regulator system will maintain the desired equilibrium pressure of the beverage at the different temperatures.

Without wanting to be bound to any theory, it appears that by providing the fluid tight third compartment with the separating wall, the pressure regulator 12 of the present disclosure provides for a better control of regulating pressure because the beverage and foam of the beverage are prevented from approaching the at least one opening 24, whereas fluid or foam cannot be trapped in a way such that it can block a gas flow through the at least one opening 24.

In stead of a single opening 24 a series of even smaller openings 24 can be provided between the second and third compartments 200, 300, together having a cross sectional surface area similar to the single one opening as discussed here before. Additionally or alternatively the at least one opening can be formed in or as a porous body allowing gas to pass through it, such as but not limited to an open cell foam material. As discussed the opening 24 can be provided for in any suitable manner, and can for example be made using a moulding system, a laser, water jet, ultrasound or any known suitable means. Alternatively the at least one opening 24 can be provided by having two or more parts meet, wherein between meeting surfaces a passage is formed for forming an opening, for example by having at least one of the surfaces having a surface roughness different from and especially higher than that of an opposite surface, such that peaks of the surfaces meet and in between such peeks passages are formed through which the gas can flow. Such surfaces can be made by moulding, wherein appropriate surfaces of the mould can be provided with the desired surface pattern and roughness to be transferred to the moulded part or parts, or can be provided on the part or parts after moulding. The desired surface roughness can be applied by for example machining, sanding, etching, blasting such as sand, ice or glass blasting, eroding, such as for example spark eroding, wire erosion, die sinking, casting or any other suitable means known to the skilled person.

The or each outlet channel or opening 21 connecting the outlet space 22 with the beverage compartment 5 may be provided at any level either in or above the beverage. The pressure device 10 may be oriented different from the position as shown in the drawings, for example with the pressure regulator 12 facing downward or to a side relative to the first compartment 100.

In FIG. 11 schematically an embodiment of such opening 24 is shown, in cross section, in which a bore 25 is provided in a wall 18 of the housing 16, having a relatively large cross section of for example between 1 and 10 mm, such as for example but by no means limited to about 2 to 5 mm. A side edge 25A of the bore 25 may be angled, such that the bore 25 tapers slightly, especially narrowing in the direction of the chamber 15. The side edge 25A can for example have a relatively low surface roughness, for example but not limited to a roughness averagely obtained by injection moulding plastics, for example but not limited to a Ra of between 0.1 and 1.6 μm. The outer surface 26A of a plug 26 inserted, especially pressed into the bore 25 may have a higher surface roughness, for example but not limited to a Ra of between 1.6 and 25 μm, wherein the roughness is orientated such that miniature channels are obtained between peaks or ridges of the surface roughness allowing gas to pass between the plug and the edge 25A of the bore 25, from the third compartment 300 to the pressure regulating chamber 15 or vice versa. The applicable or suitable roughnesses and dimensions can easily be defined by the skilled person, depending on i.a. on dimensions of bore 25 and plug 26, pressure of inserting the plug 26 in to the bore 25, gas pressures prevailing and desired flow from the third compartment 300 to the pressure regulating chamber 15 or vice versa.

The aim of the at least one opening 24 is to provide for passing of gas from the second compartment 200 into the third compartment 300 or vice versa relatively slowly, compared to a relatively sudden change in pressure and/or volume of the second compartment 200 by movement an/or deformation of the wall 17 due to for example a serving of beverage being dispensed from the beverage compartment 3. The at least one opening 24 hence provides for a time lag in compensation for the relatively sudden change in pressure and/or volume of the second chamber 200 by adding or removing gas from the second to the third compartment or vice versa and/or for allowing adjustment of a regulating pressure P2 in the second compartment 200 based on a pressure P1 in the beverage compartment without opening the outlet 14.

In FIG. 2 schematically part of an alternative embodiment is shown of a container 1 of the present disclosure, in which the same or similar elements are referred to using the same or similar reference signs as used in FIG. 1. In this embodiment a pressure regulator 12 is suspended inside a beverage compartment 3 of a container 1*m* by a lid or closure 304 connected to an opening in the top of the container, for example a neck area thereof. The gas container 11 or first compartment 100 is connected to the opposite end of the pressure regulator, here shown as the lower end. In this embodiment the housing 16 can for example be made of plastic, for example by moulding in one piece, comprising the walls 18, 18A and 19 for the second and third compartments 200, 300. The movable or deformable wall or wall part 17 is shown as a membrane 17 with a central portion 17A being thicker than a peripheral portion 17B connected to the wall 19 of the second compartment 200, closing off the pressure regulator 15 towards the outlet space 22.

The second compartment 200 is separated from the third compartment 300 by a wall 18, comprising the at least one opening 24. The separating wall 301 is connected to the peripheral wall 18A of the housing and in this embodiment is shown as a highly flexible membrane, such as for example a plastic foil, though also other embodiments are possible, as discussed further in this disclosure. The separating wall 301 can substantially freely follow pressure differences over the wall 301 by movement and/or deformation, without significant contribution itself to pressure on either side of said wall 301. For example, if in the head space 5 the pressure P2 rises, gas inside the head space 5 will push the separating wall 301 down towards the wall 18 until an equilibrium is obtained in pressure on both sides of the separating wall 301, without the wall for example being stretched or providing for a relevant or significant pressure difference over the wall, for example due to friction, deformation forces or the like. Again, when the container is left standing for a while, for example without dispensing beverage, if a pressure difference is at first present between the pressure P2 inside the second compartment or pressure regulating chamber 200, 15 and a pressure P3 in the third compartment 300, gas will pas through the at least one opening 24, until an equilibrium in said pressures P2, P3 is obtained. Which will be then substantially the same as the pressure P1 in the head space. If the pressure P2 in the beverage compartment 3 changes relatively slowly (compared to changes occurring during dispensing one or more servings of a beverage), for example due to a temperature change, this will change the volume $V_{300}$ of the third compartment 300 due to movement and/or deformation of the separating wall 301, which change in volume and hence in change in pressure P3 will be followed at a similar rate by a similar change in pressure in the pressure regulating chamber 15 due to passing of gas through the at least one opening 24.

In FIG. 3A-F steps are disclosed in a method for manufacturing a pressure regulator 12 according to the disclosure.

Figure 3B:
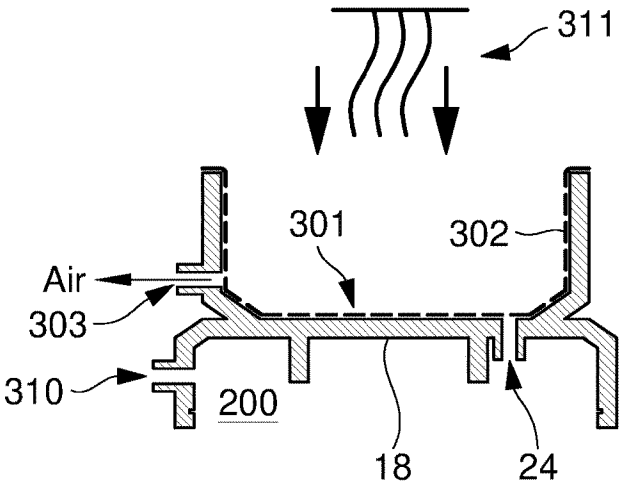
Figure 3D:
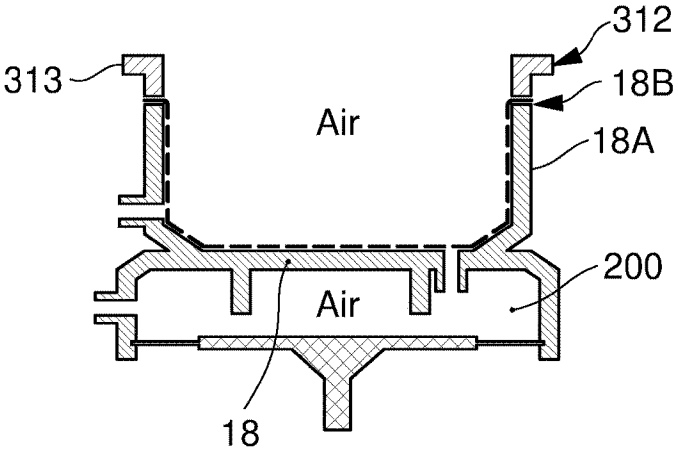
Figure 3A:
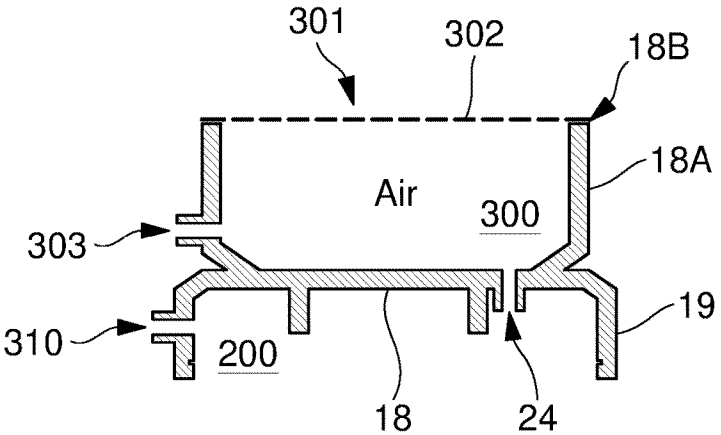

In FIG. 3A a pressure regulator housing is shown, schematically in cross section, comprising the base wall 18 comprising the at least one opening 24, the peripheral wall 18A for enclosing the third compartment 300 and the peripheral wall 19 for enclosing the second compartment 200. A foil 302 for forming the separating wall 301 is mounted on a top edge 18B of the peripheral wall 18A. This can be connected in a sealing manner by any suitable means, such as for example by welding, such as ultrasonic welding, by glue or heats sealing or the like. The third compartment 300 thus has an open upper end closed by a foil 302 forming a preform for a separating wall 301. The foil 302, here shown by a striped line, is fluid tight and flexible. The foil is for example a vacuum formable plastic film or sheet, connected to the peripheral wall 18A in any suitable, sealing manner, for example by welding. In the position shown in FIG. 3A the foil 302 is substantially flat. In the peripheral wall 18A at least one flushing opening 303 is provided, opening into the third compartment 300, below the foil 302. Moreover in this embodiment at least one second flushing opening 310 is provided in the wall 19 of the second compartment 200. In FIG. 3B air present in the third compartment 300 has been removed from the third compartment, for example through the flushing opening 303, pulling the foil 302 into the third compartment 300, preferably against the inside of the peripheral wall 18A and the bottom wall 18, as shown in FIG. 3B. Prior to and/or during deformation the foil 302 can be heated below a melting temperature, as schematically shown in FIG. 3B by heater 311. The foil 302 can be plastically deformed, such that after cooling it can lay against said walls 18, 18A substantially without tension in the foil 302. The foil 302 can be vacuum formed in situ in the pressure regulator 12. Alternatively it can be formed outside the regulator 12 and then be mounted, for example by welding.

Figure 3C:
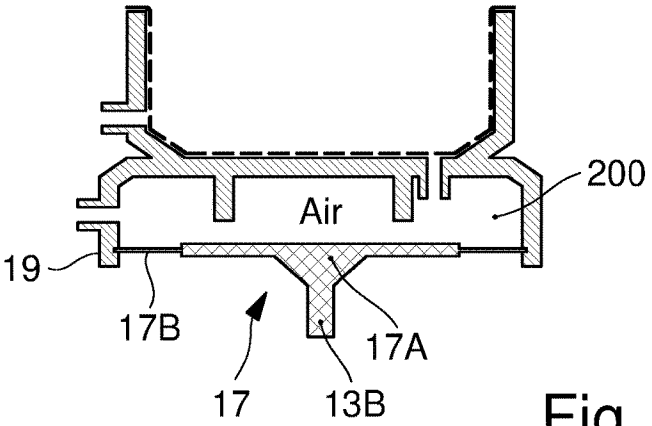

FIG. 3C shows a movable and/or deformable wall 17, such as a membrane as discussed in FIG. 2, which has been connected to the wall 19 of the second compartment 200, for closing the lower side end thereof. The stein 13B extends from the center portion 17A.

FIG. 3D shows a ring 312 being mounted on the upper edge 18B of the peripheral wall 18B, over the foil 302. The ring 312 may comprise a provision for mounting it to the lid 304, as will be discussed. Here this is shown by way of an outward extending flange 313.

If these steps are taken in atmospheric conditions, the second and third compartments 200, 300 will be filled with air under atmospheric pressure.

Figure 3E:
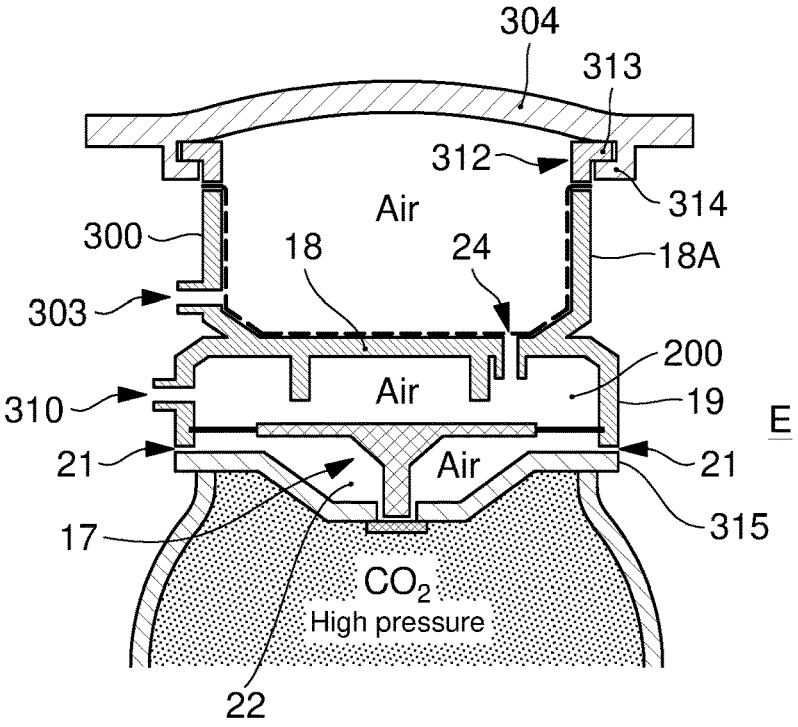

FIG. 3E shows the pressure regulator 12 connected to a lid 304 by hooking the flange 313 below hooking provisions 314 on an inside of the lid 304. Alternative means for mounting can obviously be provided, including but not limited to screwing, bolting, welding, gluing, integral forming with the ring, riveting or other means known in the art. Furthermore a pressure container 11 or first compartment 100 is mounted to the wall 19, forming an outlet space 22 between the upper side 315 of the pressure container 11 and the movable anchor deformable wall 17. One or more outlet openings 21 are provided for connecting the outlet space 22 with the environment E outside the pressure regulator 12.

Figure 3F:
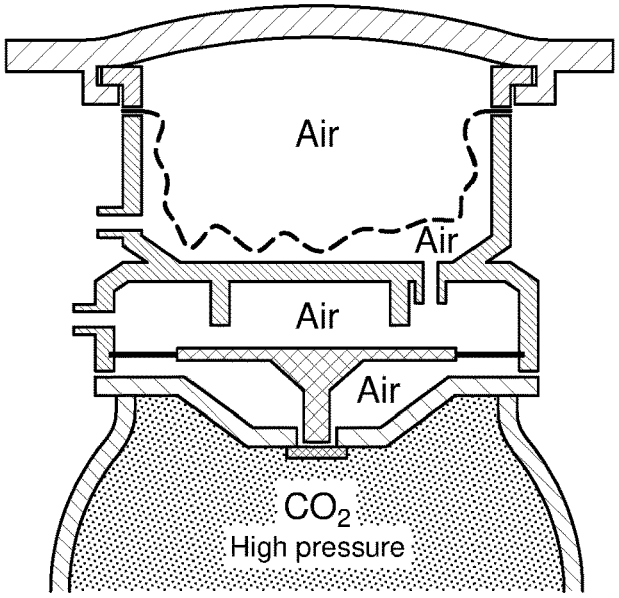

As can be seen in FIG. 3F, gas, for example air can then be forced into the third chamber 300, through the at least one flushing opening 303, forcing the foil 302 away from the walls of the third chamber 300. In FIG. 3F the foil 302 is shown in a position substantially free from the walls 18, 18A. As can be seen the foil 302 can for example be rippled or crumpled and is preferably substantially free of tension. The foil 302 can hence be deformed easily without any significant pressure difference over the foil 302.

In FIG. 4A-C three steps are shown for preparing a pressure regulator for use in a beverage container.

In FIG. 4A the pressure regulator 12 is shown, mounted on a gas container 11 or first compartment 100 containing pressurized gas, for example $CO_2$. Such gas may be pressurized such that it is partly liquefied. Air is being drawn from the third chamber 300, through the opening 303, pulling the foil 302 back against the inside of the walls 18, 18A of the third compartment 300. At the same time air is being drawn from the second compartment 200 through the further flushing opening 310. Thus preferably as much air and hence as much oxygen as possible is removed from the pressure regulator, especially form the third compartment 300 and the second compartment 200.

In FIG. 4B then flushing of pressure regulator with gas is shown, preferably the same gas, which could also be understood as a gas mixture, as is provided in the first compartment 11, 100, to be used for pressurizing beverage in a container. In the embodiment shown the gas is $CO_2$ gas. The gas is introduced into the third chamber 300 through the flushing opening 303, forcing the foil 302 outward. Moreover the gas will be allowed into the second compartment 200, preferably by using the further flushing opening 310. In embodiments gas may be introduced through the further flushing opening, at the same time allowing any remaining air as much as possible to escape through the same or a different flushing opening. In embodiments for example the further flushing opening may be used for sucking, whilst gas is introduced through the flushing opening 303 into the third compartment 300, wherein the gas can flow into the second compartment through the at leas one opening 24 in the wall 18. Combinations of these embodiments can also be used. Preferably both compartments 200, 300 are filled with the relevant gas or gas mixture only. In FIG. 3-7 a lid 304 is mounted on the pressure regulator 12, above the third chamber 300. This lid 304 can for example be made of plastic or metal and can be a lid 304 which can close off a filling opening of the container, as will be discussed. The lid 304 can moreover form a stop 305 for the pressure regulating wall, especially the foil 302 and thus defining a maximum volume $V_{300}$(max) of the third chamber 300, whereas a minimum volume $V_{300}$(min) is in the embodiments shown substantially zero.

After having introduced the gas into the third compartment 300, especially the maximum volume, as can be seen in FIG. 4C, the at least one flushing opening 303 can be closed, for example by a stopper or by welding, entrapping the gas inside the pressure regulator 12. In this position gas substantially cannot escape from the third chamber 300, other than into the second compartment 200. Similarly the or each further flushing opening 310 can be closed. Preferably as shown the volume $V_{200}$ of the second compartment 200 is significantly smaller than the maximum volume $V_{300}$ (max) of the third compartment 300. For example a maximum volume of the second compartment 200 may be less than half the maximum volume of the third compartment 300. Since the regulator will be placed in a beverage container in an environment of the same gas, substantially no gas will migrate into or out of the compartments.

FIGS. 5A and B show a pressure regulator system of the disclosure mounted in a beverage container 1. The regulator system comprising the regulator 12 and first compartment 100, i.e. the gas container 11 is inserted through a filling opening 305 of the container 1, after the beverage compartment 4 of the container 1 has been filled with a beverage, especially a pressurized beverage, preferably a gas containing beverage such as a carbonated beverage, such as beer. The lid 304 from which the pressure regulator 12 is suspended is mounted to the rim 316 of the filling opening 305, for example by welding, such as but not limited to laser welding, or any other suitable manner, closing off the beverage compartment 4. A dip tube 316 has been mounted to an outlet 8, for example to a dispensing provision 6 such as a tap 7 which can be connected to the lid 304 directly or by for example a beverage line or the like, in any suitable manner.

As can be seen in FIG. 5A the container 1 will be filled with a beverage 4, such as beer, which may contained a collar of foam 4A. Above the foam 4A a head space 5 is shown, which may be filled with air or a mixture of air and gas such as CO2. When the pressure regulator 12 with the gas container 11 and clip tube 316 is introduced through the filling opening 305, the beverage level in the container will rise, pushing the collar of foam 4A up to the rim 305. Thus all air is evacuated.

Figure 5B:
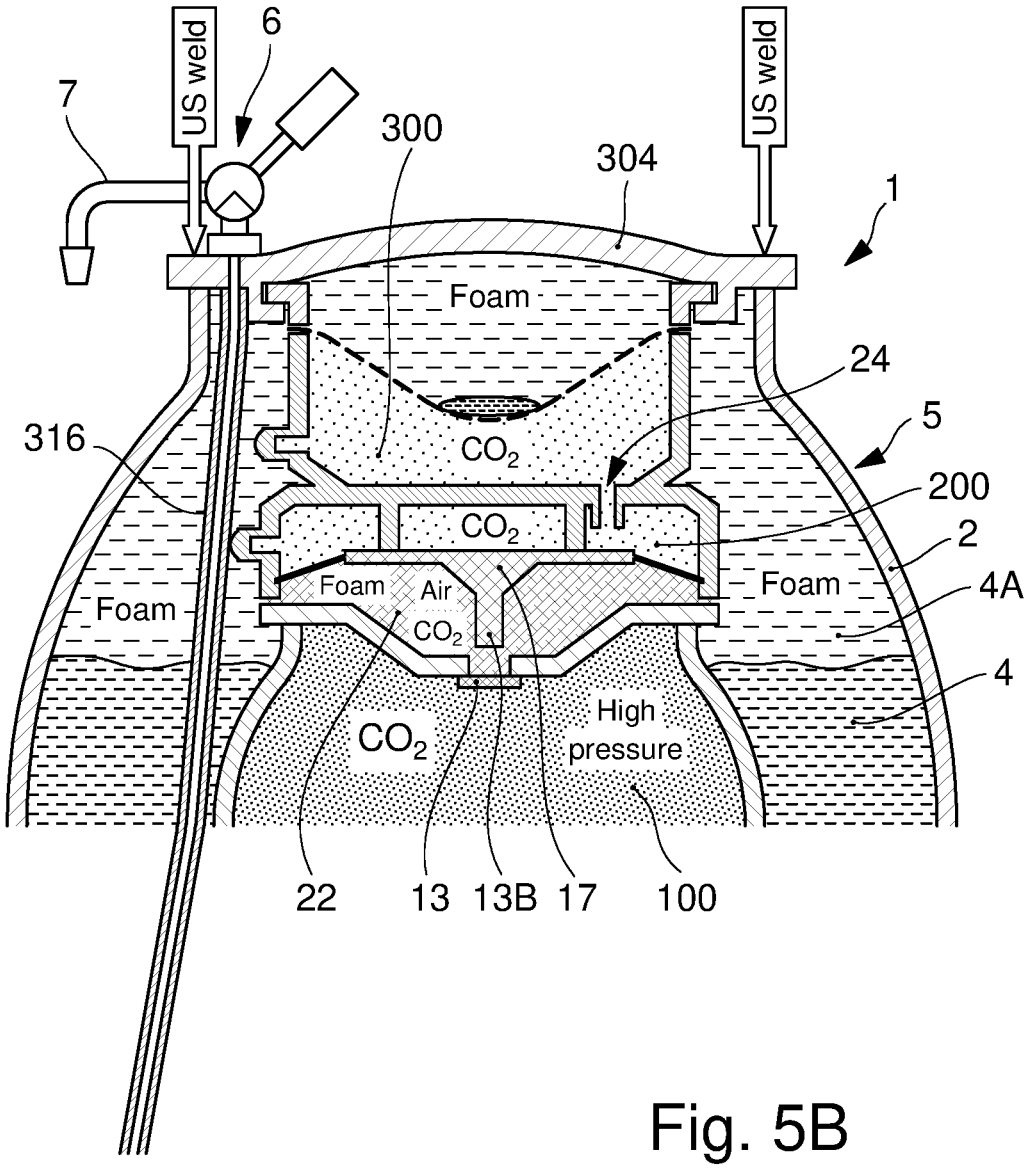

In FIG. 5B the container 1 is shown after filling and closing. The lid 304 has been mounted to the rim 305 in any suitable manner, such as for example but not limited to by welding, such as ultrasonic welding. The pressure in the outlet space 22 of the pressure regulator 12 will allow the wall 17 to be forced down, opening the valve and allowing gas to flow from the first compartment 100 into the beverage compartment through the outlet space. This will increase the pressure in the beverage compartment, which will force the foil 302 down, compressing the gas inside the third chamber 300, whereas the foil 302 as a separating wall 301 will prevent fluid or foam from entering into the third compartment 300. In FIG. 5B the container 1 is shown after having been closed, wherein the pressure $P_3$ in the third compartment has been raised. Since the pressure in the outlet space 22 has also been raised, the wall 17 is forced upward, reducing the volume $V_{200}$ of the second compartment 200 and closing the valve 13 again.

It will be clear that at least gas can easily pass the connection between the ring 312 and the lid 304, such that the pressure inside the beverage compartment can act on the separating wall 301. As can be seen in e.g. FIG. 6-9, after a while the foam 4A will largely settle and be liquefied again, leaving a head space 5 substantially filled with gas.

In this position the container 1 will be transported and stored. Due to the opening or openings 24 a pressure equilibrium will result between the third and second compartment 300, 200, which will be substantially the same as the equilibrium pressure of the beverage in the container at the given temperature. Such is for example shown in FIG. 6.

Should during for example storing or transport of the container with the beverage the pressure inside the beverage compartment 3 change, for example resulting from a temperature change, the separating wall will allow the pressure in the second and third compartment 200, 300 to follow such change, adjusting the regulating pressure inside the second compartment 200 to match the changed equilibrium pressure in the beverage.

Figure 7B:
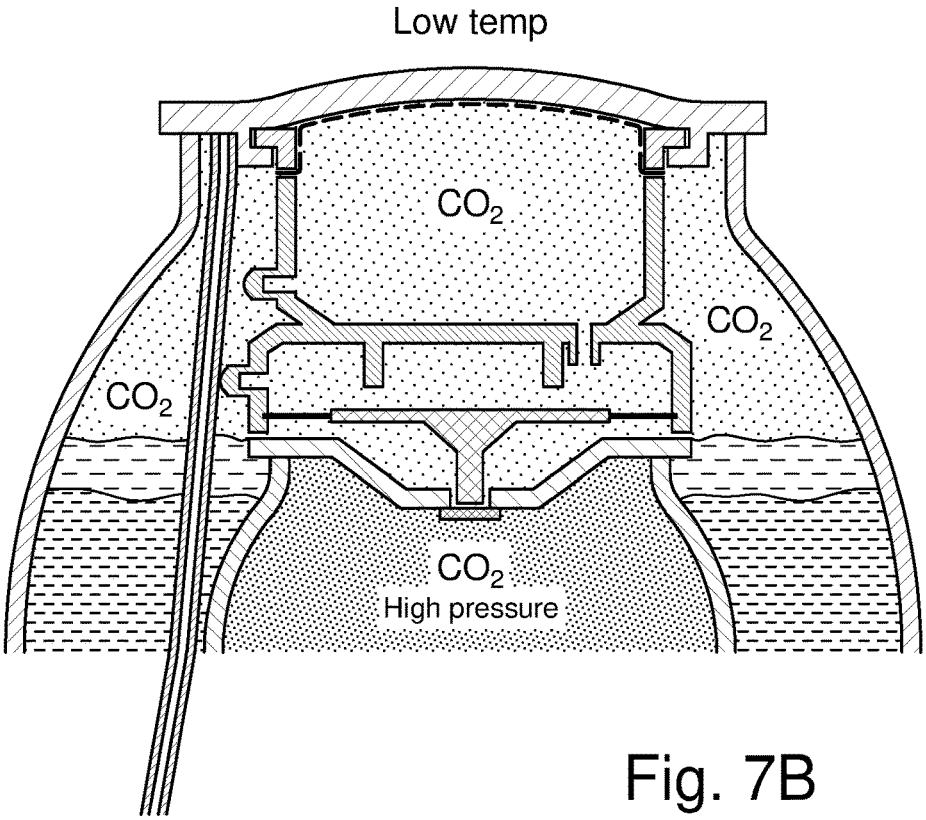

In FIGS. 7A and 7B by way of example two possible situations are shown. In FIG. 7A the foil 302 is shown in a substantially midway position between the bottom 18 and the stop 304. Pressure inside the beverage container will be relatively low, for example due to significant cooling of the container 1 and beverage therein. In FIG. 7B on the other hand the foil 302 has been pushed all the way against the bottom 18 of the third chamber 300, due to a high pressure in the beverage container. For example due to a high beverage pressure. Since temperature and pressure changes during storage and transport will normally happen only gradually, the pressure in the pressure regulator will follow the pressure change in the beverage compartment by allowing gas to flow from the third compartment into the second compartment or vice versa, through the opening or openings 24, acting as throttle opening(s). For example, increase in the pressure in the beverage compartment will increase the pressure inside the third compartment by forcing the foil down, which will over time make gas to flow from the third compartment into the second compartment 200, increasing the regulating pressure in the second compartment to about the pressure in the beverage compartment. On the other hand, decreasing pressure in the beverage compartment will allow gas to flow from the second compartment into the third, decreasing the regulating pressure to about the pressure in the beverage compartment. Hence the regulating pressure will follow relatively slow pressure changes in the beverage.

However, if beverage is dispensed from the container 1, as shown in FIGS. 8A and 9, the pressure P1 will drop rapidly in the beverage compartment 3. This means that the pressure will also drop inside the outlet space 22, allowing the wall 17 to be forced down, opening the valve 13 and allowing gas to flow into the beverage compartment 3, raising the pressure again. This will all happen in seconds, during which time no or only a very limited amount of gas will flow from the third compartment 300 into the second 200. This means that the pressure in the second compartment 200 will not significantly change due to such minute amount of gas. This means that after a short while the pressure P1 inside the beverage compartment 3 will again be back at the regulating pressure and the valve 13 will be closed again since the wall 17 will have been forced back up. Hence the regulating pressure will be maintained at the desired level, despite the dispensing of beverage.

As can be seen in FIG. 9, after several servings have been dispensed through the tap 7, the pressure may still be accurately regulated. If the equilibrium pressure would change in the container 1, due to for example the remaining gas volume or due to the significantly reduced beverage volume, the regulating pressure in the second compartment 200 may adjust slowly to the new equilibrium pressure.

With a system of the present disclosure beverage can be dispensed, especially but not limited to beverage comprising a gas or gas mixture, such as beverage containing $CO_2$ and/or $NO_2$ or mixtures of $CO_2$ and/or $NO_2$ and other gas(ses).

In embodiments according to the disclosure the third compartment 300 has a maximum volume V300$_{(max)}$ which is larger than the maximum volume V200$_{(max)}$ of the second compartment 200. Preferably at least twice the volume, more preferably at least three times the volume, for example about 5 to 7 times the volume.

By way of example, in an embodiment for dispensing beer, such as lager beer, containing $CO_2$ gas the pressure in a head space of the container will be the same as the pressure in the beverage. For beer for example an equilibrium pressure of about 1.6 bar (1.600.000 Pascal) absolute may be present at a beverage temperature of about 0° C., whereas the pressure may be about 5.5 bar ($5.5*10^6$ Pascal) at a temperature of about 40° C. The system can be designed such that at said lower pressure of 1.6 Bar the volume of the third compartment is maximal (V300$_{(max)}$) whereas at said higher pressure of 5.5 bar said volume is minimal (V300$_{(min)}$). Due to the separating wall configuration the pressure difference between the third compartment 300 and the head space will be very low, as discussed, in the order of tens of millibar. Pascals law of P*V/T for the second and third compartment 200, 300 will lead to a ration between the volumes V300$_{(max)}$ and V200$_{(max)}$ of at least about 5:1.

In an example the volume V300$_{(max)}$ can be about 25000 $mm^3$, and the volume V200$_{(max)}$ can be about 4200 $mm^3$, wherein the opening 24 or the combined openings 24 can for example be about 10 to 100 $(\mu m)^2$, for example between 10 and 50 $(\mu m)^2$. Hence the system will respond to quick pressure drops due to dispensing of beverage, for example a pressure drop of tenths of bars in less than a minute, by adding gas into the beverage compartment from the first compartment 100, while the pressure in the third compartment 300 will hardly change, whereas when for example a pressure change in the beverage occurs due to a change in temperature, which will take far longer, for example hours, gas may flow from the second compartment 200 into the third compartment 300 or vice versa very slowly, such that the regulating pressure P2 in the second compartment 200, which forms a pressure regulating chamber, will be amended to the equilibrium pressure in the head space 5.

FIG. 10A-E show alternative embodiments of pressure regulating walls or wall parts 301.

Figure 10A:
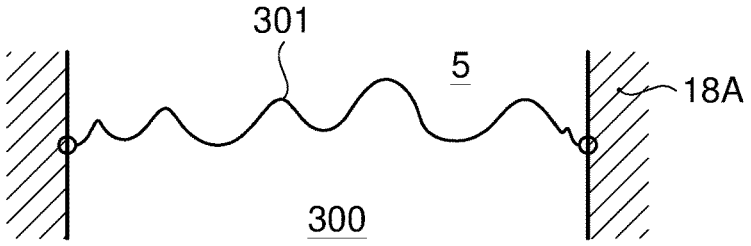
Figure 10B:
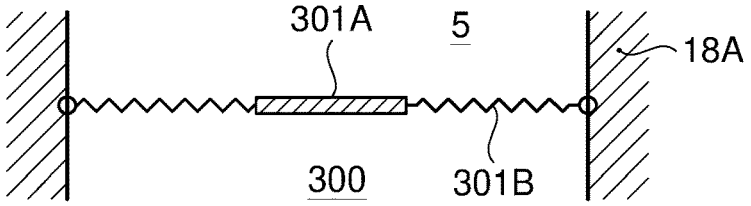
Figure 10C:
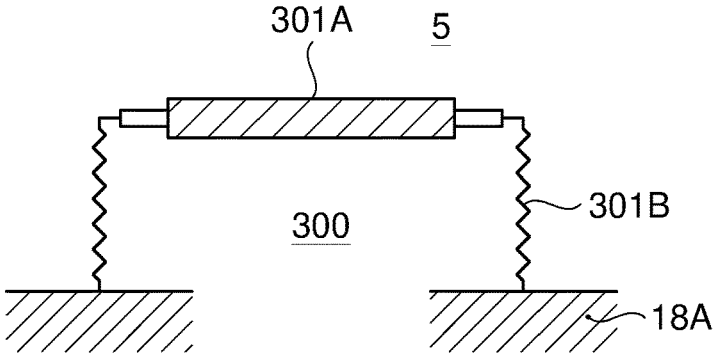
Figure 10D:
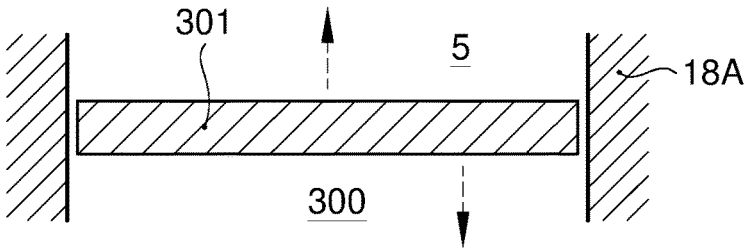
Figure 10E:
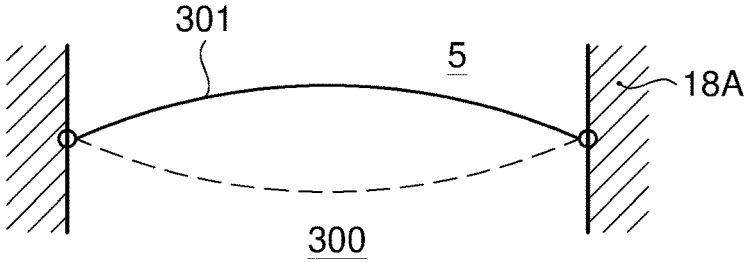

FIG. 10A shows the wall 301 formed as an undulating membrane fixed in a fixed position at the periphery to the peripheral wall 18A. FIG. 10B shows a combination of a relatively stiff plate element 301A connected to a flexible membrane ring 301B which in turn is connected sealingly to the peripheral wall 18A. FIG. 10C shows an embodiment similar to that of FIG. 10B, but here the flexible membrane portion is formed as a substantially tubular element 301B. FIG. 10D shows a piston type separating wall 301, which seals against an inner side of the peripheral wall 18A at very low friction, for example by suing a friction reducing plastic or coating, such as but not limited to Teflon. FIG. 10E shows an embodiment of a separating wall 301 which is substantially continuous and which is highly flexible and stretchable, such that it can change shape between the V300(min) and V300(max) without significant force necessary. Such can for example be made of a rubber or artificial rubber, silicon or the like and very thin, for example one to several micrometers or less.

In FIG. 12 an alternative embodiment is shown, of a pressurizing system 10, comprising a pressure regulator 12, for example as discussed before, wherein again an opening 24 is provided in a wall 18 of the second compartment 200. The third compartment 300 in this embodiment is comprises by a balloon shaped separating wall 301 substantially fully enclosing the third compartment 301. The wall 301 preferably is made of a flexible material such as a thin foil, for example having a thickness of micrometers, which may be substantially non-elastic and/or at least substantially does not need to be stretched between a minimum working volume V300(min) and maximum working volume V300 (max). The opening 24 again can function as a throttle opening, allowing passage of gas into and from the third compartment 300 relatively slowly, such that when a rapid pressure drop occurs in the second compartment, especially during dispensing of a serving of beverage, this pressure drop cannot be quickly compensated for by gas flowing from the third compartment 300 into the second compartment 200, but over time the pressure drop can be compensated for. In such embodiment obviously in stead of the opening 24 a neck 313 of the chamber 300 can having the throttle function. Again during use the system will automatically regulate towards an equilibrium situation in which a minimal pressure difference over the wall 301 will be set, such as described before.

FIG. 13 schematically shows part of a pressure regulator 12, similar to FIG. 11, wherein however the opening 24 is provided differently. In this embodiment a relatively large opening 24A is provided in the wall 18, over which is closed off by a wall part 24C which is relatively thin comparted to the wall thickness W of the wall 18. The wall part 24C can for example be a foil provided over the opening 24A. The foil can for example have a thickness $T_{24C}$ of less than a millimeter, for example less than 0.5 mm, such as for example 0.3 mm or less. In said wall part 24C the actual opening or openings 24 is/are provided, for example by puncturing the wall part 24C with a needle. The opening 24 can for example have a circular shape with a diameter of less than 10 micrometer (μm), for example less than 5 micrometer, such as for example about 3 micrometer. The wall part 24C can for example be mounted to the wall by gluing or welding.

The present invention is by no means limited to the embodiments shown and discussed by way of example only. Many variations thereof are possible within the scope of the appending claims. For example the third compartment can be provided in a different position, for example to a side of the second compartment or partly within the second compartment, as long as there is a time lagged pressure equalizing provision between them, such as one or more openings 24 as described by way of example. The third compartment may in its entirety be made to allow increase and decrease of its volume, such as for example as a balloon, especially a balloon requiring very little force to be blown up to a suitable volume V300(max), such balloon being connected to the at least one opening 24 or such pressure equaling lagging provision, as shown in FIG. 12. These and may comparable variations, as well as combinations thereof, are understood to fall within the framework of the invention as outlined by the claims. Naturally, different aspects of the different embodiments and/or combinations thereof can be combined with each other and be exchanged within the framework of the invention. Therefore, the embodiments mentioned should not be understood to be imitative.

The invention claimed is:

1. A pressure regulating system for a beverage container system, comprising a first compartment for containing a pressurized gas, in fluid communication with an outlet space through at least a gas valve for opening and closing a passage between the first compartment and the outlet space, wherein a gas valve control system is provided, comprising a deformable and/or movable wall or wall part of said outlet space, wherein said deformable and/or movable wall or wall part is operably in contact with said gas valve for opening and/or closing said gas valve, wherein a second compartment is provided at a side of the said deformable and/or movable wall or wall part opposite the outlet space, wherein the second compartment is in fluid communication with a third compartment such that gas can flow either way between the second compartment and the third compartment, which third compartment comprises at least one separating wall part and is at least liquid tight.

2. Pressure regulating system according to claim 1, wherein the separating wall part is part of or is or comprises a movable and/or deformable wall part.

3. Pressure regulating system according to claim 1, wherein the separating wall part is gas permeable and liquid tight.

4. Pressure regulating system according to claim 1, wherein the second compartment is in fluid connection with the third compartment through at least one opening or a series of openings, wherein the opening has or the openings have a combined cross sectional area of less than about 100 $\mu m^2$.

5. Pressure regulating system according to claim 1, wherein the outlet space comprises an outlet opening or a series of outlet openings, and the second and third compartment are in fluid connection with each other through a passage opening or a series of passage openings, wherein the outlet opening has or the outlet openings have a combined cross sectional area, larger than the cross sectional area of the passage opening or of the combined passage openings.

6. The pressure regulating system according to claim 5, wherein the outlet opening has or the outlet openings have a combined cross sectional area, at least twice the cross sectional area of the passage opening or of the combined passage openings.

7. Pressure regulating system according to claim 1, wherein during use at least the first, second and third compartment are substantially filled with the same gas or gas mixture, in gaseous and/or liquid form, especially $CO_2$.

8. The pressure regulating system according to claim 7, wherein the gas is $CO_2$.

9. Pressure regulating system according to claim 1, wherein a stop is provided for the separating wall part, limiting a possible volume increase of the third compartment by movement and/or deformation of the separating wall part.

10. Pressure regulating system according to claim 1, wherein the volume of the third compartment is larger than the volume of the second compartment, at least when comparing the maximum volumes of the second and third compartments.

11. Pressure regulating system according to claim 1, wherein at least one of the second and the third compartment comprises at least one flushing opening, which during use of the regulator for pressure regulation is closed.

12. Pressure regulator for use in a pressure regulating system according to claim 1, wherein at least the second and third compartment and at least part of the outlet space are provided within the pressure regulator, and wherein the pressure regulator further includes a connecting provision for connecting the pressure regulator to the first compartment.

13. The pressure regulator according to claim 12, wherein the first compartment is a gas container.

14. Beverage container, comprising the pressure regulating system according to claim 1, wherein the outlet space opens into a beverage compartment of the beverage container, and wherein the separating wall part is provided in or in direct fluid contact with said beverage compartment.

15. Method for preparing the pressure regulating system according to claim 1, wherein at least the third compartment is, and preferably the second and the third compartment are, purged with a gas or gas mixture which is preferably the same as the gas or gas mixture present in a beverage to be pressurized with said pressure regulator, especially $CO_2$ gas or $NO_2$ gas or a $CO_2$ or $NO_2$ gas mixture.

16. Method according to claim 15, wherein at least one of the second and the third compartment is, preferably both of the second and the third compartment are flushed with said gas or gas mixture, by feeding the gas or gas mixture into the third compartment through a first opening and allowing air to be forced out of said third compartment by said gas or gas mixture through a second opening, and subsequently closing the openings.

17. Method for manufacturing the pressure regulator for a pressure regulating system according to claim 1, wherein a regulator part is formed comprising at least the second compartment and a bottom wall and a peripheral wall of the third compartment, wherein a foil is connected to the peripheral wall spaced apart from the bottom wall, closing off the third compartment, where after the third compartment is evacuated, such that the foil is plastically deformed, drawing the foil against an inside of the peripheral wall and the bottom wall.

18. A pressure regulating system for a beverage container system, comprising a first compartment for containing a pressurized gas, in fluid communication with an outlet space through at least a gas valve for opening and closing a passage between the first compartment and the outlet space, wherein a gas valve control system is provided, comprising a deformable and/or movable wall or wall part of said outlet space, wherein said deformable and/or movable wall or wall part is operably in contact with said gas valve for opening and/or closing said gas valve, wherein a second compartment is provided at a side of the said deformable and/or movable wall or wall part opposite the outlet space, wherein the second compartment is in fluid communication with a third compartment, which third compartment comprises at least one separating wall part and is at least liquid tight, and wherein the separating wall part comprises at least a movable and/or deformable wall part allowing increase and decrease of an internal volume of the third compartment, wherein the movable and/or deformable wall part of the second compartment allows for an increase and decrease of the volume of the second compartment, wherein the fluid connection between the second and third compartment is designed such that a change in volume of the second compartment leads to a volume change of the third compartment with a time lag and vice versa.

19. A pressure regulating system for a beverage container system, comprising a first compartment for containing a pressurized gas, in fluid communication with an outlet space through at least a gas valve for opening and closing a passage between the first compartment and the outlet space, wherein a gas valve control system is provided, comprising a deformable and/or movable wall or wall part of said outlet space, wherein said deformable and/or movable wall or wall part is operably in contact with said gas valve for opening and/or closing said gas valve, wherein a second compartment is provided at a side of the said deformable and/or movable wall or wall part opposite the outlet space, wherein the second compartment is in fluid communication with a third compartment, which third compartment comprises at least one separating wall part and is at least liquid tight, and wherein the separating wall part comprises a foil.

20. Pressure regulating system according to claim 19, wherein the foil is connected to a wall of the chamber spaced apart from a separating wall separating the third compartment from the second compartment, and is shaped and/or dimensioned such that it can rest against substantially the full inner surface of the walls of the third compartment.

21. The pressure regulating system according to claim 20, wherein the foil is shaped and/or dimensioned such that it can rest against substantially the full inner surface of the walls of the third compartment without being stretched.

22. The pressure regulating system according to claim 19, wherein the foil is a plastic foil.

23. The pressure regulating system according to claim 22, wherein the foil is a substantially non-elastic foil.

* * * * *